US009687037B1

(12) United States Patent
Colello et al.

(10) Patent No.: US 9,687,037 B1
(45) Date of Patent: Jun. 27, 2017

(54) MAGNETIC FOOTBALL HELMET TO REDUCE CONCUSSION INJURIES

(71) Applicant: Virginia Commonwealth University, Richmond, VA (US)

(72) Inventors: Raymond J. Colello, Chesterfield, VA (US); Rebecca E. Caffrey, N Chesterfield, VA (US)

(73) Assignee: Virginia Commonwealth University, Richmond, VA (US)

( * ) Notice: Subject to any disclaimer, the term of this patent is extended or adjusted under 35 U.S.C. 154(b) by 0 days.

(21) Appl. No.: 14/616,381

(22) Filed: Feb. 6, 2015

Related U.S. Application Data

(60) Provisional application No. 61/936,509, filed on Feb. 6, 2014, provisional application No. 62/075,019, filed
(Continued)

(51) Int. Cl.
*A42B 3/04* (2006.01)
*A42B 3/06* (2006.01)

(52) U.S. Cl.
CPC ..... *A42B 3/0406* (2013.01)

(58) Field of Classification Search
CPC ..... A42B 3/046; A42B 3/0473; A42B 3/064; A42B 3/06; A42B 3/04; A42B 3/063;
(Continued)

(56) References Cited

U.S. PATENT DOCUMENTS 2,597,601 A 5/1952 Sherman
2,655,379 A 10/1953 Miller
(Continued)

FOREIGN PATENT DOCUMENTS

CA 2725057 A1 6/2012
CN 2790847 6/2006
(Continued)

OTHER PUBLICATIONS

"The K&J Repelling Magnet Calculator" (https://www.kjmagnetics.com/calculator.repel.asp) and "Neodymium Magnet Information" (https://www.kjmagnetics.com/neomaginfo.asp) Available Online at least as early as Jan. 22, 2012 as indicated in "ResellerRatings Website Printout" (http://www.resellerratings.com/store/K_J_Magnetics), 14 pages.
(Continued)

*Primary Examiner* — Bobby Muromoto, Jr.
(74) *Attorney, Agent, or Firm* — New River Valley IP Law, PC; Michele L. Mayberry

(57) ABSTRACT

Helmets which harness magnetic forces to reduce the force of impact collisions to helmets during contact sports, thus reducing the likelihood that athletes sustain a physical injury such as a traumatic brain injury and/or a neck injury, are described. The helmets incorporate strong magnets into the shell such that a repulsive magnetic force is generated between opposing helmets, thus reducing impact forces. Each helmet includes a protective shell and at least one magnet which is arranged or configured to provide for a spatially modulated magnetic array.

22 Claims, 21 Drawing Sheets

Related U.S. Application Data on Nov. 4, 2014, provisional application No. 62/093,537, filed on Dec. 18, 2014.

(58) Field of Classification Search

CPC ..... A42B 3/12; A42B 3/00; A42B 3/0406; A42B 1/08; A42B 3/068; A42B 3/122; A42B 3/124; A42B 3/14; A63B 71/10; A63B 2243/007; A63B 2102/14; A63B 2102/22; A63B 2220/00; A63B 2220/44; A63B 2220/836; A63B 2225/20; A63B 2071/0063; A63B 2220/80; A63B 2220/833; A63B 2225/50; A63B 2230/00; A63B 71/0054; A41D 13/015; A41D 13/0002

See application file for complete search history.

(56) References Cited

U.S. PATENT DOCUMENTS 3,419,271 A † 12/1968 Waskosky
3,831,847 A † 8/1974 Serritella
3,841,683 A 10/1974 Toro
3,937,508 A 2/1976 Glance et al.
4,042,057 A 8/1977 Beckley
4,069,732 A * 1/1978 Moskowitz ..... G10H 3/183 84/727
4,167,282 A 9/1979 Matsuyama
4,592,580 A 6/1986 Stanganelli et al.
4,807,915 A 2/1989 Shyi
4,878,552 A * 11/1989 Gebo ..... G01G 7/02 177/210 R
4,889,394 A 12/1989 Ruspa
4,993,985 A 2/1991 Bass et al.
5,092,835 A 3/1992 Schurig et al.
5,127,599 A 7/1992 Veraart
5,306,222 A 4/1994 Wilkinson
5,370,430 A 12/1994 Mozafari
5,595,564 A 1/1997 Pinna
5,738,624 A 4/1998 Zablotsky et al.
5,782,743 A 7/1998 Russell
5,871,438 A 2/1999 Ardizzone
5,950,239 A 9/1999 Lopez
5,971,451 A 10/1999 Huang
6,163,889 A 12/2000 Tate
6,258,020 B1 7/2001 Lopez
6,267,720 B1 7/2001 Knox et al.
6,332,862 B1 12/2001 Zandman
6,379,295 B1 4/2002 Woo
6,565,147 B1 5/2003 Beals
6,652,445 B1 11/2003 Woo
6,913,663 B2 7/2005 Komatsu
7,029,432 B2 4/2006 Woo
7,052,447 B2 5/2006 Whittaker
7,097,610 B2 8/2006 Woo
7,140,047 B2 11/2006 Kronenberger
7,444,683 B2 11/2008 Prendergast et al.
7,526,389 B2 * 4/2009 Greenwald ..... A42B 3/046 2/425
7,771,341 B2 8/2010 Rogers
8,015,624 B2 9/2011 Baldackin et al.
8,062,229 B2 11/2011 Rauscher
8,191,180 B2 * 6/2012 Berry ..... A41D 13/0512 2/425
8,191,421 B2 * 6/2012 Petelenz ..... F41H 1/02 73/11.01
8,256,026 B2 9/2012 Garrigos
8,296,868 B2 10/2012 Belanger et al.
8,308,784 B2 11/2012 Streeter et al.
8,403,402 B1 3/2013 Portela
8,556,831 B1 * 10/2013 Faber ..... A42B 3/046 340/500
8,578,520 B2 * 11/2013 Halldin ..... A42B 3/064 2/411
8,616,362 B1 12/2013 Browne et al.
8,712,706 B2 * 4/2014 Leskowitz ..... G01R 33/3875 335/209
8,736,128 B2 * 5/2014 Dede ..... H02K 29/03 310/191
8,739,599 B2 * 6/2014 Hennig ..... A63B 71/085 73/12.01
8,766,798 B2 * 7/2014 Howard ..... A42B 3/046 340/479
8,797,165 B2 * 8/2014 Greenwald ..... A61B 5/0002 2/411
8,801,589 B2 8/2014 Peterchev et al.
8,847,755 B2 * 9/2014 Howard ..... G08B 13/1427 2/245
8,863,319 B2 * 10/2014 Knight ..... A42B 3/064 2/411
8,884,756 B2 * 11/2014 Howard ..... G08B 13/1427 340/10.1
8,890,686 B2 * 11/2014 Howard ..... A42B 3/046 340/10.1
8,896,457 B2 * 11/2014 Howard ..... G08B 13/1427 2/425
8,938,301 B2 * 1/2015 Hagedorn ..... A61B 5/0478 607/45
8,961,440 B2 * 2/2015 Huang ..... A61B 5/4064 600/587
8,981,952 B2 * 3/2015 Howard ..... A42B 3/046 2/10
9,041,528 B2 * 5/2015 Howard ..... A42B 3/046 340/5.61
9,044,198 B2 * 6/2015 Benzel ..... A42B 3/046
9,072,330 B2 * 7/2015 Yoon ..... A42B 3/069
9,226,707 B2 * 1/2016 Huang ..... A42B 3/0473
2003/0201767 A1 * 10/2003 Khalfin ..... G01S 1/024 324/207.17
2004/0139975 A1 * 7/2004 Nelson ..... A61F 2/00 128/848
2006/0054245 A1 * 3/2006 Liu ..... C22C 33/0278 148/105
2006/0218703 A1 * 10/2006 Prendergast ..... G02B 23/125 2/422
2007/0050892 A1 * 3/2007 Charles ..... A62B 18/025 2/410
2007/0098199 A1 * 5/2007 Goldberg ..... A42B 3/30 381/376
2007/0131309 A1 * 6/2007 Shigemoto ..... B22D 11/0611 148/101
2007/0138892 A1 * 6/2007 Horst ..... H02K 1/2766 310/156.53
2007/0159021 A1 * 7/2007 Horst ..... H02K 1/2766 310/156.53
2007/0192933 A1 * 8/2007 Kam ..... A42B 1/247 2/171
2008/0024013 A1 * 1/2008 Essex ..... F03H 99/00 310/12.04
2008/0246573 A1 * 10/2008 Souder ..... A61N 2/06 335/306
2008/0256685 A1 10/2008 Lampe et al.
2008/0281144 A1 11/2008 Cameron et al.
2009/0044315 A1 2/2009 Belanger et al.
2009/0051111 A1 2/2009 Andersen
2010/0107318 A1 5/2010 Asta
2010/0208322 A1 * 8/2010 Borchers ..... H04N 9/3129 359/223.1
2010/0244590 A1 9/2010 Essex
2010/0263110 A1 * 10/2010 Berry ..... A42B 3/0473 2/459
2010/0275347 A1 11/2010 Baldackin et al.
2010/0326192 A1 * 12/2010 Petelenz ..... F41H 1/02 73/579
2011/0057756 A1 * 3/2011 Marinescu ..... B22F 1/007 335/302
2011/0137589 A1 * 6/2011 Leskowitz ..... G01R 33/3875 702/57
2011/0251802 A1 10/2011 Song

(56) References Cited

U.S. PATENT DOCUMENTS

2012/0000008 A1* 1/2012 Baldackin ..... A42B 3/065 2/410
2012/0019341 A1* 1/2012 Gabay ..... B22F 1/0018 335/306
2012/0048663 A1* 3/2012 McDonnell ..... A43B 1/0054 188/266
2012/0167277 A1 7/2012 Dunleavy et al.
2012/0174294 A1 7/2012 Sackett
2012/0180203 A1 7/2012 Giroux et al.
2012/0297526 A1 11/2012 Leon
2013/0014314 A1 1/2013 Krauter
2013/0019384 A1* 1/2013 Knight ..... A42B 3/064 2/411
2013/0125294 A1* 5/2013 Ferrara ..... A42B 3/064 2/411
2013/0219658 A1 8/2013 Krajewski et al.
2014/0000012 A1* 1/2014 Mustapha ..... H01F 7/02 2/414
2014/0013493 A1* 1/2014 Blunt ..... A42B 3/04 2/422
2014/0109304 A1 4/2014 Kwan et al.
2014/0215693 A1* 8/2014 O'Gara ..... A42B 3/069 2/410
2014/0259307 A1 9/2014 Moss et al.
2014/0259308 A1 9/2014 Moss et al.
2014/0283286 A1* 9/2014 Yoon ..... A42B 3/069 2/411
2014/0323921 A1* 10/2014 Huang ..... A61B 5/4064 600/587
2015/0080768 A1* 3/2015 Huang ..... A42B 3/0473 600/595
2015/0173676 A1* 6/2015 Greenwald ..... A61B 5/0002 600/595
2015/0208750 A1* 7/2015 White ..... A61B 5/11 2/462
2015/0216247 A1* 8/2015 Price ..... A42B 3/069 2/414
2015/0223542 A1* 8/2015 Fischell ..... A42B 3/0473 2/461
2015/0237923 A1* 8/2015 Yoon ..... A42B 3/069 2/411
2015/0245680 A1* 9/2015 Partlo ..... A42B 3/0473 2/411
2015/0305423 A1* 10/2015 Pusateri ..... A42B 1/08 2/2.5
2015/0317801 A1* 11/2015 Bentley ..... H04N 7/181 382/107
2015/0335090 A1* 11/2015 Wegener ..... A42B 3/08 2/421
2016/0018278 A1* 1/2016 Jeter, II ..... G01L 5/0052 340/665
2016/0029733 A1* 2/2016 Kovarik ..... A42B 3/125 2/411
2016/0040743 A1* 2/2016 Staton ..... F16F 13/005 2/412
2016/0058093 A1* 3/2016 Kennard ..... A42B 3/06 2/411

FOREIGN PATENT DOCUMENTS

DE 3325104 1/1985
EP 0323038 B1 8/1993
JP 55119542 9/1980
KR 1020130047100 5/2013
WO 2011008317 A1 1/2011

OTHER PUBLICATIONS

U.S. Appl. No. 13/796,620.
McKee et al., "Chronic Traumatic Encephalopathy in Athletes: Progressive Tauopathy following Repetitive Head Injury," (2009) J. Neuropathol. Exp. Neurol. 68, pp. 709-735.
Nathan Abouhalkah and Austin Wood, "MagForceHelmets—Protecting the mind", pp. 1-12, Publishedon Dec. 20, 2012, Prezi power point (https://prezi.com/133zghvakvci/magforce-helmets/).
Standard performance specification for newly manufactured football helmets. National Operating Committee on Standards for Athletic Equipment (NOCSAE) DOC (ND)002-98m05 Jul. 2005, 8 pages.
Third Party Submission under 37 CFR 1.290 filed on Feb. 6, 2015 against U.S. Appl. No. 13/796,620, 22 pages.
Nathan Abouhalkah and Austin Wood, "MagForce Helmets—Protecting the mind", pp. 1-12, Published on Dec. 20, 2012, Prezi power point (https://prezi.com/133zghvakvci/magforce-helmets/.†
"The K&J Repelling Magnet Calculator", https://www.kjmagnetics.com/calculator.repel.asp "Neodymium Magnet Information", https://www.kjmagnetics.com/neomaginfo.asp Available Online at least as early as Jan. 22, 2012.†

* cited by examiner
† cited by third party

One 21-year-old defensive end took 537 hits to the head during a season of football games and practices at the University of North Carolina. Of those, 417 had magnitudes of 10 g or more (shown). Two resulted in concussion.

Hit below 80g
Hit above 80g
Concussion

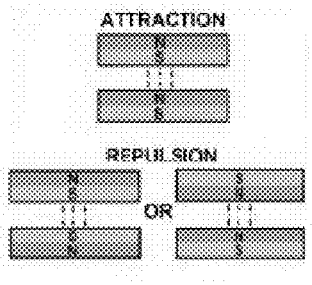
FIG. 5A
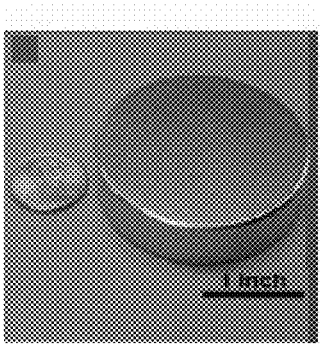
FIG. 5B
- Dimensions: 2" dia. x 1/2" thick
- Material NdFeB, Grade N52
- Plating/Coating: Ni-Cu-Ni (Nickel)
- Magnetization Direction:
  Axis (Poles on Flat Ends)
- Weight: 6.81 oz. (193 g)
- Surface Field: 3309 Gauss
- Max Operating Temp: 176°F (80°C)
FIG. 5C
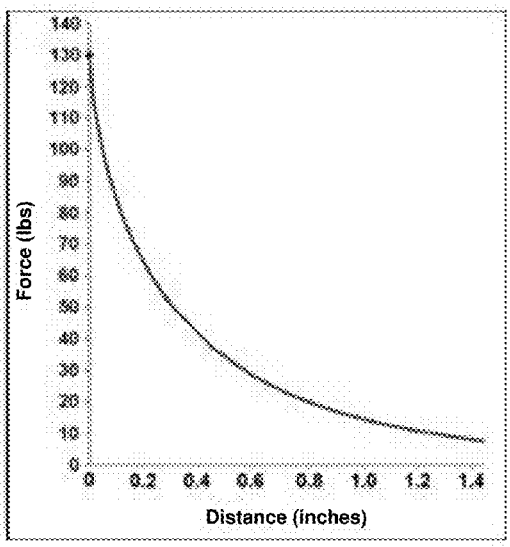
FIG. 5D

MAGNETIC FOOTBALL HELMET TO REDUCE CONCUSSION INJURIES

CROSS-REFERENCE TO RELATED APPLICATIONS

This application claims priority to and the benefit of the filing dates of U.S. Provisional Application No. 61/936,509, filed Feb. 6, 2014, U.S. Provisional Application No. 62/075,019, filed Nov. 4, 2014, and U.S. Provisional Application No. 62/093,537, filed Dec. 18, 2014, the disclosures of which are hereby incorporated by reference herein in their entireties.

FIELD OF THE INVENTION

This disclosure relates generally to the field of protective headwear, and in particular, to the design of protective helmets, such as those used in athletic sports, which reduces the likelihood of traumatic brain injury (TBI) and neck injury from linear and rotational blows to the head sustained while participating in contact sports.

BACKGROUND OF THE INVENTION

Concussions, otherwise known as Traumatic Brain Injury or TBI, are a major cause of morbidity and mortality in the US, and thus represent a public health issue that costs society money and lives. Of the 1.4 million who sustain some sort of TBI in the US annually, approximately 50,000 result in death, approximately 235,000 result in hospitalization, and approximately 1.1 million result in treatment from an emergency department. Among children up to 14 years old, TBI results in an estimated 2,685 deaths, 37,000 hospitalizations, and 435,000 emergency department visits annually (Source: Centers for Disease Control).

It has been estimated that 1,178,000 people play football in the United States (1.1 million in high school, 68,000 in college and 1,700 professionally). Over 100,000 concussions occur annually in all levels of football. An estimated 60% of TBI sustained in football are from head-to-head collisions. The average number of concussions sustained by NFL players was about 9 per week between 2009 and 2012.

A TBI occurs when a violent blow to the head causes the brain to slam against the skull beyond the ability of the cerebrospinal fluid to cushion the impact. As an example, when a football player sustains a blow to the head, the speeds of impact range from 17-25 mph with a force averaging 98 times the force of gravity. A study by the NFL revealed that most hits occurred from a blow to the side of the head, often to the lower half of the face, and to the forehead. When the players receive a blow to the head, a shock wave passes through the brain and bounces back off the skull. The initial blow may be due to linear (direct) impact or rotational (indirect) impact (FIG. 1). The concussion usually occurs at the opposite side of the point of impact. The impact may cause bruising of the brain, tearing of blood vessels, and nerve damage. The initial blow is termed the "coup" and the damage to the other side of the brain is termed the "contrecoup" or counter-blow, and this counter-blow often results in confusion, swelling, and blood clots. Additionally, rotational forces from angular blows may occur resulting in shearing and twisting of the brain within the skull (FIG. 2). (Sources: Mayoclinic.com, Biokinetics, Washington Post, Science Daily, kidshealth.org, Kaiser Permanente, Denver Post).

Many athletes sustain repeated traumatic brain injuries over the course of a playing career. Repeated concussions can cause Chronic Traumatic Encephalopathy (CTE). CTE is a progressive degenerative disease of the brain found in athletes (and others) with a history of repetitive brain trauma, including symptomatic concussions as well as asymptomatic sub-concussive hits to the head. The brain degeneration is associated with memory loss, confusion, impaired judgment, impulse control problems, aggression, depression, and, eventually, progressive dementia (Source: McKee et al., (2009) J. Neuropathol. Exp. Neurol. 68:709-35). Researchers at the Department of Veteran's Affairs brain repository have found evidence of a degenerative brain disease in 76 of the 79 former NFL players whose brains have been examined.

TBI in contact sports leagues like the NFL are a big and expensive problem. According to the online blog NFL Concussion Litigation, since the first official concussion lawsuit filed against the NFL in August 2011, nearly 250 other complaints against the NFL were filed through May 2013. In total, more than 4,500 players have filed suit against the NFL for concussion injury-related claims, most of them retirees.

Concussions typically occur when g-forces typically equal to or in excess of 100 g are applied to the head but may occur at lower g-forces. An extreme hit in the context of football may subject the player's head to g-forces approaching 150 g. As used herein the term "g-force" refers to the acceleration of an object relative to free-fall. As is typical in the art, the unit of measure g (also G), where for a stationary object on earth 1 g is equivalent to standard gravity ($g_n$), 9.80665 meters per square second, an object has 0 g in a weightless environment such as free-fall or an orbiting satellite, and g-forces exceed 1 g on, for instance, accelerating rockets and roller coasters. As a point of reference, 100 g is about 10× the g force experienced by a fighter pilot in an F-16 during a jet roll. FIG. 3 illustrates the magnitude, position and direction of blows to the head sustained by a single college football player during the course of 1 season of games and practices at UNC. The player sustained 537 hits, 2 of which caused concussions (black lines). Note that the two that caused concussions were to the forehead and side of the face. These areas are most likely to be impacted by the helmet of another player. Another concentration of blows occurs to the back of the head, but these are primarily due to the back of the head hitting the ground rather than other players.

The traditional approach to reduce the number of concussion injuries has been to identify means to disperse, displace, and/or absorb some of the energy produced during helmet-to-helmet collisions. Typical commercially available protective helmets today consists of a polycarbonate shell with an internal liner. In this design, the hard outer shell distributes force away from the point of impact, while the liner, which is generally made of foam, pads, or air-filled cells, absorbs some of that impact energy. Although this general design is acknowledged for significantly reducing mortality on the playing field, the prevalence of concussions at all levels of play suggest that further design modifications are required. Consequently, helmet manufacturers have made structural and material modifications to the internal air-filled or foam-filled padding design that they claim are able to reduce the rate of concussions (FIG. 4). However, recent research has shown negligible differences in concussion rates among 1,332 high school football players wearing three different brands of helmets.

The most common method employed for diffusing impacts relies on air or foam-filled padding inside the helmet. FIGS. 4A-4C illustrate the typical design and padding configurations for three of the most common helmets sold commercially today.

In particular, FIG. 4A illustrates the interior view of the padding configuration of a commercially available football helmet (the Riddell Revolution Speed® football helmet). FIG. 4B illustrates the interior view of the padding configuration of a commercially available football helmet (the Schutt Vengeance® football helmet). FIG. 4C show the lateral view of a commercially available football helmet (the Xenith X1® football helmet), with the polycarbonate shell made transparent, to show the placement of 18 shock absorbers within the liner of the helmet. Common elements include: (1) facemask, on front of helmet (2) occipital features on back bottom of helmet, (3) chin guard and chin strap, (4) polycarbonate outer shell, (5) occipital (rear) padding array, (6) cheek pad, (7) frontal (forehead) padding array, (8) inner helmet lining to which padding is attached, (9) a standard air-cushion padding element, and (10) the space between the inner and outer helmet in which the padding elements are positioned.

The padding configurations illustrated in FIGS. 4A-4C provide protection to the frontal, temporal, and occipital part of the head and is representative of the padding configuration typically found in most helmet designs.

Helmet safety is rated by the National Operating Committee on Standards for Athletic Equipment (NOCSAE). Testing of helmets includes dropping them on rigs to test the ability of the helmet to withstand impact on the sides, front, back, and top of the helmet. The NOCSAE rating system comprises awarding 0-5 stars to specific helmet models, wherein 5 stars is the safest "best available", 4 stars is "very good", 3 stars is "good", 2 stars is "adequate", 1 star is "marginal", and 0 stars is "not recommended." (Source: STANDARD PERFORMANCE SPECIFICATION FOR NEWLY MANUFACTURED FOOTBALL HELMETS. NATIONAL OPERATING COMMITTEE ON STANDARDS FOR ATHLETIC EQUIPMENT (NOCSAE) DOC (ND)002-98m05 July 2005).

There are five established criteria for helmet modifications that must be considered when improving upon the current state of the art. In particular, (1) the design cannot affect the look, style and intensity of play; (2) the design should not dramatically affect the dimensions and look of the standardized helmet designed and accepted by NOCSAE; (3) the design should be able to be integrated in exist football helmet designs with little modification and within 1 to 2 years; (4) the design should be cost efficient and adaptable for play at all ages; and (5) the design should reduce the chance that the wearer will suffer a concussion. Additionally, it is desirable that any design improvements not significantly add to the weight of the helmet as this would become uncomfortable and cumbersome for the players.

Use of magnetic fields for the prevention and/or reduction of impact effects has been considered across a variety of fields where impact is frequent. For instance, magnetic fields have been used to prevent or reduce slamming or the over-closure of doors (see U.S. Pat. App. Pub. No.: 2013/0219658, which is incorporated by reference, in its entirety, into this application). Magnets have also been investigated for use in protective helmets. In particular magnetic repulsive forces have been disclosed for impact absorption in protective body gear, such as football helmets (see U.S. Pat. App. Pub. No.: 2013/0125294, which is incorporated by reference, in its entirety, into this application) and other team sports where contact is frequent or necessary to the game (see U.S. Pat. App. Pub. No.: 2014/0215693, which is incorporated by reference, in its entirety, into this application).

To date, however, magnets have not been properly incorporated in protective helmet technology to decelerate impact, reduce collision forces, and mitigate neck injuries stemming from laminar motion and the sticking together of helmets—both of which would be caused by magnet configurations described in the prior art. In some instances, the existing helmets comprising magnets do not differentiate between coup and countercoup injuries, and described helmet designs would not mitigate both coup and countercoup injuries. For example, the prior art helmets employ a system of spaced small magnets in "cells" between the inner and outer shells of the helmet, which act in the same way as traditional helmet padding. These cells would cushion a blow to the head, however, due to their small size, they may not decrease the actual impact velocity from a second identical helmet in a collision.

In other instances, the magnets in existing helmets are attracted to one another's sides when incorporated into a helmet design without magnetic shielding or improperly configured. Such designs caused the helmets to stick together at some angles of impact and/or caused laminar motion between two opposing helmets.

In particular, existing helmets have magnets configured such that they act solely to repulse another identically configured magnetic helmet, neither providing any protection from the counter-coup that results from an impact which may occur nor protection from a near-uniform repulsive force around the head of the wearer of the helmet. Such is not an optimal design for prevention of TBI, and actually would cause rotational energy to be applied to the neck of the wearer due to the shape of the magnetic field. It will be appreciated by anyone who has experimented with magnets that when one forcefully slams together two magnets in a N—N or S—S configuration, the magnets do not just repel one another; due to the shape of the magnetic field, the magnets quickly change direction and "slide" off of one another. The conversion of a nearly linear impact vectors to a different vector as the helmets come into proximity with force is not a problem in the lab. However, when the helmets are secured to human heads, the rapid change in vector can result in significant twisting/rotational force on the neck, causing muscular injury, injury to the cervical spine, and/or potentially injury to the spinal cord if the cervical spine is damaged significantly. Consequently, alternative approaches to diffuse impact energy need to be conceived.

The helmet described herein solves these unanticipated problems by modifying the spatially modulated magnetic fields (SMMF) of the magnetic elements (which may otherwise be referred to as magnets in the context of this specification). Methods to modify the SMMF can include ferromagnetic shielding, grouping of magnetic elements, and use of Halbach arrays. Therefore the helmet described herein comprises a substantially improved design over the prior art and will prevent head injuries without inducing neck injuries due to serious design flaws.

SUMMARY OF THE INVENTION

Described herein is a protective helmet that slows collision speeds and reduces impact force during helmet-to-helmet collisions by using the repulsive force of a system of magnetic elements comprising one or more permanent rare earth magnet. A "magnetic element" for the purpose of this application is defined as a unit comprised of one or more magnets alone, or a unit comprised of one or more magnets contacted by ferromagnetic shielding and optionally an impact-absorbing material. Thus a magnetic element can be considered to be a unit comprised of multiple materials, which generates a SMMF because it contains at least 1 magnet. In preliminary studies we have shown that light weight neodymium magnets can generate repulsive forces of over 500-fold their weight and that these forces can significantly reduce impact forces generated during collision. By arranging magnetic arrays of defined strength, number and spatial orientation within at least two opposing helmets we are able to mitigate impact forces generated at helmet-to-helmet collisions. The addition of magnetic elements to the standard football helmet design would complement existing helmet pad lining to reduce impact energy, a likely consequence of which would be a reduction in the number of concussions on the playing field.

The described helmet utilizes a system of magnetic elements, which comprise at least one permanent magnet such as the rare-earth magnets that contain a percentage of neodymium (e.g., the commercially available N52 magnets). In one embodiment of the invention, the magnets are positioned in each helmet with the same poles (N or S) facing outward from the surface of the helmet(s) such that when the respective helmets are brought into proximity to one another on an impact collision course, the repulsive force of the magnets contained within the helmet(s) (1) decelerate the velocity of the helmets movement towards one another; (2) decrease the impact force if an impact occurs; and/or (3) minimize transference of an impact force through the outer shell of the helmet to the inner layer which is in contact with the skull. The result is that the initial blow to the head (termed the "coup", that is on the side of impact) and the countercoup (the injury on the opposite side of the impact that results from the brain impacting the inside of the skull) is either minimized, or avoided altogether, resulting in a substantially lowered chance of TBI compared to the chance of developing TBI if the helmet were not in place to dampen the force of impact. The traditional approach to reduce concussions aims to reduce impact forces after the collision has occurred. The described helmet "puts the brakes" on before the impact even occurs.

It is an object of the described helmet to include a helmet having a protective shell and at least one magnet (for example, disposed on or in the helmet), wherein the at least one magnet is arranged or configured to provide for a spatially modulated magnetic field, and in certain embodiments, a Halbach array. In certain aspects the helmet will comprise at least 3 magnetic elements wherein the first magnetic element is disposed in the front of the helmet, a second magnetic element is disposed on one side of the helmet, and a third magnetic element is disposed on the side of the helmet opposite the second magnetic element.

It is a further object of the described helmet that the magnet(s) used therein is a permanent magnet, such as a magnet comprising a rare earth metal such as gadolinium, terbium, erbium, dysprosium, scandium, yttrium, lanthanum, praseodymium, samarium, europium, holmium, thulium, ytterbium, lutetium, neodymium, alloys thereof, and combinations thereof. The magnet can further comprise one or more ferromagnetic materials such as iron, cobalt, nickel, gadolinium, dysprosium, alloys thereof, europium oxide, ferric oxide, and combinations thereof. In certain embodiments, the magnet used in the helmets described herein is a neodymium-iron-boride (NdFeB) magnet.

It is still a further object of the described helmet to magnetically shield the magnets to obtain a spatially modulated magnetic field. Magnetically shielding materials can be stainless steel or mu-metals like NiFe alloys.

It is still another object to provide a helmet system comprising a first helmet comprising at least one magnetic element arranged or configured to provide for a first spatially modulated magnetic field and a second helmet comprising at least one magnet arranged or configured to provide for a second spatially modulated magnetic field, wherein (1) the first spatially modulated magnetic field and the second spatially modulated magnetic field are configured to allow repulsive force between the first and second helmets, (2) the first spatially modulated magnetic field and the second spatially modulated magnetic field are configured to fit together to prevent laminar motion between the first and second helmets, and/or (3) the first spatially modulated magnetic field and the second spatially modulated magnetic field are configured such that when the magnetic elements in the first and second helmets approach one another, the helmets repel one another and preferably do not stick together.

It is a further object to provide a helmet comprising a first plurality of magnets configured to provide a first magnetic field that substantially exhibits a first Halbach flux distribution, or a helmet system comprising one or more such helmets.

BRIEF DESCRIPTION OF THE DRAWINGS

In order to describe the manner in which the above-recited and other advantages and features of the disclosed embodiments can be obtained, a more particular description will be provided by reference to specific embodiments which are illustrated in the appended drawings. The drawings depict only exemplary embodiments and are not, therefore, to be considered to be limiting of its scope. The embodiments will be described and explained with additional specificity and detail through the use of the accompanying drawings in which:

FIG. 5A is a schematic illustrating the attractive and repulsive forces generated by magnetic discs, which are axially magnetized.

FIG. 5B is a photographic representation showing the relative size of an individual neodymium grade N52 magnet identical to those used in the studies discussed herein.

FIG. 5C is a schematic outlining the dimensions and specification for the magnet shown in FIG. 5B.

FIG. 5D is a graphical representation depicting the repulsive force generated by two N52 magnets with like poles (N,N) facing each other.

DETAILED DESCRIPTION

Figure 1:
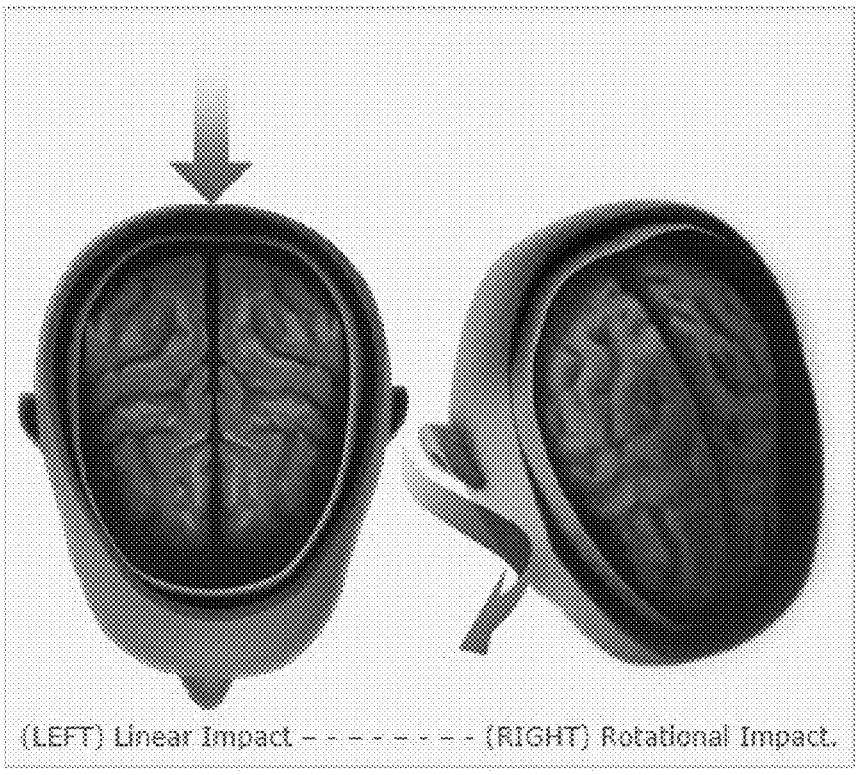
FIG. 1 is an illustration of linear (direct) and rotational (indirect) blows to the skull.
Figure 2:
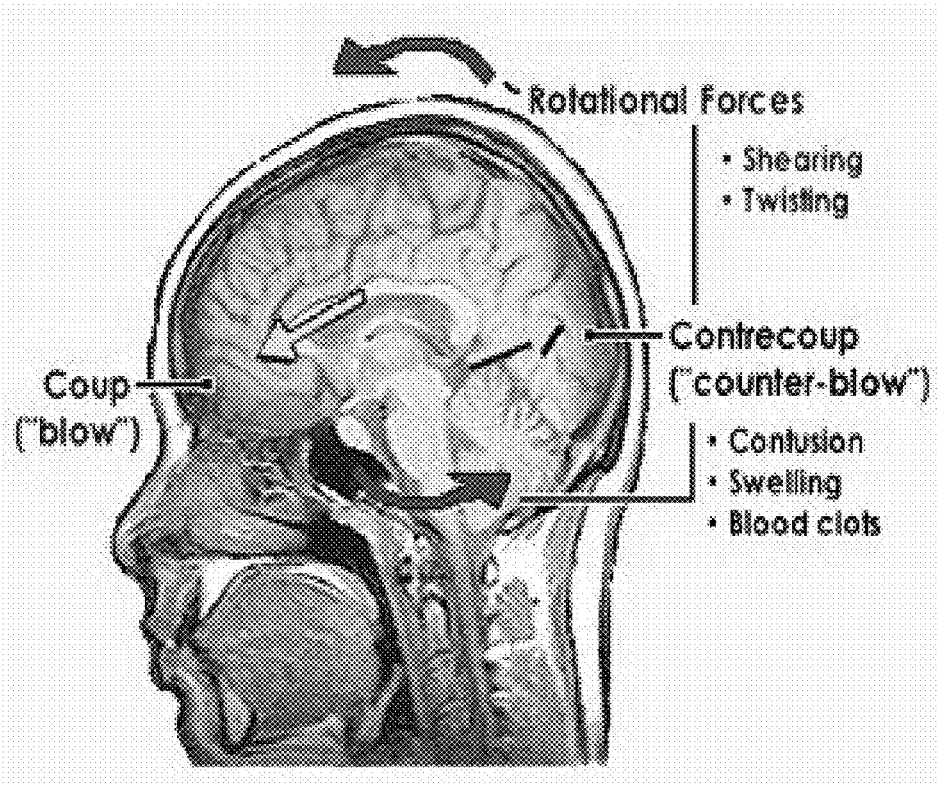
FIG. 2 is an illustration of mechanisms of coup/contre-coup traumatic brain injuries.

The helmets described herein comprise a helmet and at least one magnet disposed thereon. As provided throughout, the term helmet may encompass any protective headgear known in the art. Non-limiting examples of helmets include football helmets, baseball helmets, hockey helmets, racecar driving helmets, motorcycle helmets, bicycle helmets, skateboard helmets, construction hardhats/helmets, etc. In particular aspects, the helmet described herein is a football helmet. As described herein, the term "football helmet(s)" refers to the protective helmets used when participating in the sport of American football.

Helmets described herein comprise a protective shell and an inner lining. Modern football helmets are composed of a hard protective shell (primarily made out of polycarbonate) and an inner lining. At least one magnet may be placed anywhere on the helmet so long as the magnet is able to reduce impact forces following a collision. In one aspect, the at least one magnetic element is placed directly on the outer shell of the football helmet. In a particular aspect, the at least one magnetic element is placed on the inside of the football helmet. In an even more particular aspect, the at least one magnetic element is placed between the outer shell of the helmet and the inner lining of the helmet. In still a more particular embodiment, at least 3 magnetic elements are placed between the outer shell of the helmet and the inner lining of the helmet. Still more particularly, the at least 3 magnetic elements are configured/arranged to have spatially modulated magnetic fields (SMMF) or arrays.

As used herein, the terms "spatially modulated magnetic field(s)" means magnetic fields featuring an arrangement of magnetic regions that vary in orientation and strength from one spatial position to another, resulting in a magnetic multipole field that is strong at close range ("near field"), but which falls off rapidly with increasing distance. Such a magnetic multipole field is of higher order than an ordinary magnetic dipole field. A spatially modulated magnetic field may also be custom-configured with a special spatially modulated pattern of magnetic regions to have a particularly strong magnetic interaction when brought into magnetic proximity with another array that has been custom-configured to be complementary to the same pattern. The strong magnetic interaction not only can attract the spatially modulated arrays toward one another or repulse them from one another, but can also align them to particular positions and angles, according to the specific pattern. Halbach arrays can be used to generate spatially modulated magnetic fields. As used herein, the term "Halbach array(s)" or "Halbach magnet array(s)" means an arrangement or configuration (e.g., an array) of permanent magnets that augments the magnetic field at one side, end or edge of the array while cancelling or reducing the magnetic field at the other side, end or edge of the array to substantially zero.

In aspects where the at least 3 magnetic elements are configured on the helmet to have spatially modulated magnetic fields, the magnets are placed in various locations within the helmet with like poles facing outwards to use the repulsive forces of their SMMF to decelerate and/or prevent impact from a similarly configured helmet worn by an opposing player to reduce the transmission of force to the inner shell and ultimately the player's head. The reduction of force is extremely important in that this drastic change in momentum is the leading cause of concussions today.

Figure 3:
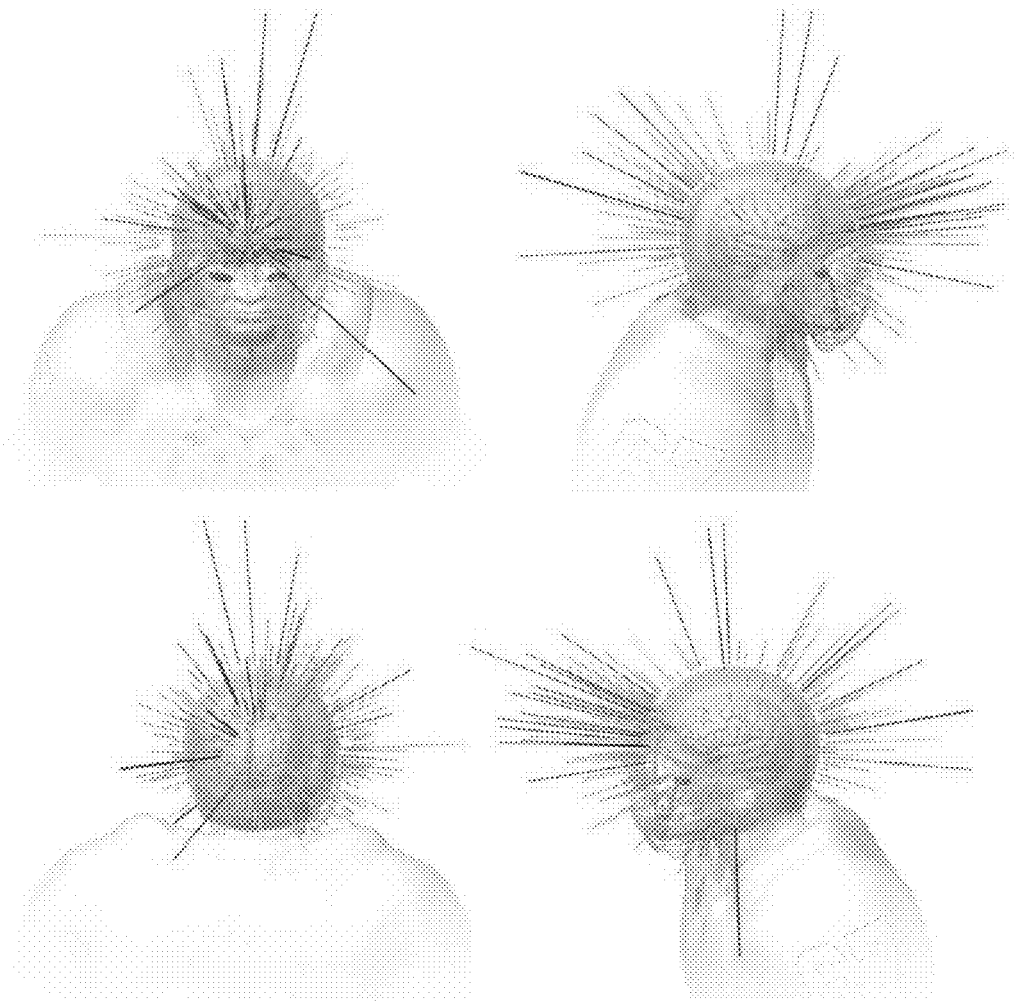
FIG. 3 is an illustration of position and angle of blows to the head sustained by a college football player at the University of North Carolina.

In particular aspects, the combination of magnets/magnetic elements are arranged in a configuration corresponding to at least the 3 areas of helmets that are impacted when concussions are sustained by helmet-to-helmet collisions (see FIG. 3), corresponding to the frontal/forehead area, and the temporal areas (sides of head and face). The size and shape of single magnetic elements or arrays of magnetic elements may be designed to correspond to the current padding measurements in these areas of current commercially sold helmets, or to correspond to spaces between padding in current designs of commercially available helmets. For example, in the football helmet shown in FIG. 4C (commercially available as the Xenith X1® helmet), the diameter of the shock absorbers (2" diameter) within the helmet matches the diameter of the magnets shown in FIGS. 5A-5D. This helmet, like others, can be manufactured with shock absorbers or padding of varying thicknesses to accommodate a combination of magnetic elements at the key impact points.

Magnets

The helmets described herein can comprise at least one magnetic element, as in, for example, 1 magnetic element, 2 magnetic elements, 3 magnetic elements, 4 magnetic elements, 5 magnetic elements, 6 magnetic elements, 7 magnetic elements, 8 magnetic elements, 9 magnetic elements, 10 magnetic elements, and so on. In particular embodiments, the helmet will include at least 3 magnetic elements. It will be understood that for the 3 locations for magnetic apparatus in our preferred embodiment (both sides, and the forehead area), the apparatus may comprise one or more magnetic elements in a given helmet. The magnetic element, if a single unit, may be of any shape and may be a composite of magnets of various strengths, or a single unit. The at least one magnetic element may have one or more magnetic component areas where polarity is reversed or one or more members of a group of magnets where polarity is reversed in order to engineer the best spatially modulated magnetic field for this application. Additionally, if a plurality or grouping of magnets is used in a given area to achieve an optimal spatially modulated magnetic field, the members comprising the group may have different strengths and shapes in order to achieve the optimal spatially modulated magnetic field. Furthermore, magnetic elements may be added to other areas of the helmet for further impact cushioning. The magnetic elements may be placed together in groups in discreet areas, or in a dispersed configuration similar to FIG. 4C.

As provided herein, the at least one magnetic element may be any magnet so long as the magnet or plurality of magnets are sufficiently capable of reducing impact forces. The term "magnet" as used herein means an object or material that produces a magnetic field. In particular, magnets include permanent magnets and electromagnets. The term "permanent magnet" as used herein indicates a magnet made from a material that stays magnetized. Exemplary materials that can be used to make a permanent magnet include iron, nickel, cobalt, rare earth metals and some of their alloys, and some naturally occurring minerals such as lodestone. Magnetism may be generated in any manner known to the skilled artisan who is practicing embodiments of the helmet described herein.

There are many varieties of permanent magnet materials including neodymium magnets (which are some of the most powerful permanent magnets known at this time), samarium-cobalt magnets, ceramic magnets, plastic magnets, Alnico magnets as well as traditional ferrous magnets. Exemplary permanent magnets include neodymium-iron-boride (NdFeB) magnets, ferrous metal magnets, samarium-cobalt magnets, or any other magnetic material. High-pull-force magnets may be flexible or inflexible. High-pull-force magnets may be made of sintered metal powder or of metal or any other magnetizable material.

In a particular embodiment, the at least one magnet suitable for the helmet described herein is a permanent magnet. In a more particular embodiment, the at least one permanent magnet comprises at least one rare earth metal. Non-limiting examples of rare earth metals suitable for use as magnets for the helmets described herein include gadolinium, terbium, erbium, dysprosium, scandium, yttrium, lanthanum, praseodymium, samarium, europium, holmium, thulium, ytterbium, lutetium, neodymium, alloys thereof and the like.

In a particular aspect, the at least one magnet includes at least one rare earth metal and at least one ferromagnetic material. Non-limiting examples of ferromagnetic materials include iron, cobalt, nickel, gadolinium, dysprosium, alloys thereof, europium oxide, ferric oxide, and the like. In a more particular aspect, the at least one magnet comprises iron and at least one rare earth element. In a further aspect, the rare earth element is neodymium and the at least one ferromagnetic material is iron.

In still another aspect, the at least one magnet comprises a boride material. In a more particular aspect, the at least one magnet comprises at least one rare earth element, at least one ferromagnetic material, and at least one boride material. In a specific embodiment, the at least one magnet is neodymium iron boride (NdFeB). NdFeB are some of the strongest types of permanent magnets commercially available and are graded according to their maximum energy product, with higher values indicating stronger magnets ranging from N27 up to N52. In a more specific embodiment, the at least one magnet is a NdFeB magnet wherein the NdFeB magnet is a N27, N30, N33, N35, N38, N40, N42, N45, N48, N50, N52, N30M, N33M, N35M, N38M, N40M, N42M, N45M, N48M, N50M, N30H, N33H, N35H, N38H, N40H, N42H, N45H, N48H, N30SH, N33SH, N35SH, N38SH, N40SH, N42SH, N45SH, N28UH, N30UH, N33UH, N35UH, N38UH, N40UH, N28EH, N30EH, N33EH, N35EH, N38EH, or N33VH/AH grade magnet. In an even more particular embodiment, the at least one NdFeB magnet is a N33, N35, N38, N40, N42, N45, N48, N50, or N52 grade magnet. In still an even more particular embodiment, the at least one NdFeB magnet is a N52 grade magnet.

When these permanent neodymium rare-earth magnetic elements are incorporated into the helmet design they can produce between about 50 pounds and about 125 pounds of repulsive force when they are not contacted by magnetic shielding, for example, such as 50 pounds of repulsive force, 60 pounds of repulsive force, 70 pounds of repulsive force, 80 pounds of repulsive force, 90 pounds of repulsive force, 100 pounds of repulsive force, 105 pounds of repulsive force, 110 pounds of repulsive force, 115 pounds of repulsive force, 120 pounds of repulsive force, 125 pounds of repulsive force, and so on to provide a few examples. The repulsive force on one side of the magnet may be at least doubled when magnetic shielding contacts the opposing surface of the magnet.

In a particular embodiment, the repulsive force generated by the magnet or plurality of magnets used in the described helmet is between about 50 pounds of repulsive force and 125 pounds of repulsive force. In still a more particular embodiment, the repulsive force generated by the magnet or plurality of magnets is between about 50 pounds of repulsive force and 100 pounds of repulsive force. In still yet another particular embodiment, the repulsive force generated by the magnet or plurality of magnets is between about 75 pounds of repulsive force and 125 pounds of repulsive force. In yet still another particular embodiment, the repulsive force generated by the magnet or plurality of magnets is between about 75 pounds of repulsive force and 100 pounds of repulsive force.

Characteristics of neodymium magnets are seen in FIGS. 5A-D and FIGS. 6A-6B. The repulsive forces generated by a single magnet or multiple magnets are shown in FIG. 7D. The addition of magnets to the standard football helmet design would complement existing helmet padding and magnetic elements may be used in conjunction with traditional air, foam, or cell padding known to those familiar with the art.

It is desirable that the at least one magnet incorporated into the at least one magnetic element used on the helmet described herein have sufficient repulsive force to reduce impact forces. Electromagnetic fields may be described using a unit of magnetic flux density known as a "Tesla." Another unit of measure commonly used is the "Gauss", where 1 Tesla equals 10,000 Gauss. In particular embodiments, the magnet or plurality of magnets used in the helmets described herein will generate a flux density (i.e., magnetic field) in the range of about 500 Gauss to about 5,000 Gauss, e.g., such as 500 Gauss, 600 Gauss, 700 Gauss, 800 Gauss, 900 Gauss, 1,000 Gauss, 1,100 Gauss, 1,200 Gauss, 1,300 Gauss, 1,400 Gauss, 1,500 Gauss, 1,600 Gauss, 1,700 Gauss, 1,800 Gauss, 1,900 Gauss, 2,000 Gauss, 2,100 Gauss, 2,200 Gauss, 2,300 Gauss, 2,400 Gauss, 2,500 Gauss, 2,600 Gauss, 2,700 Gauss, 2,800 Gauss, 2,900 Gauss, 3,000 Gauss, 3,100 Gauss, 3,200 Gauss, 3,300 Gauss, 3,400 Gauss, 3,500 Gauss, 3,600 Gauss, 3,700 Gauss, 3,800 Gauss, 3,900 Gauss, 4,000 Gauss, 4,100 Gauss, 4,200 Gauss, 4,300 Gauss, 4,400 Gauss, 4,500 Gauss, 4,600 Gauss, 4,700 Gauss, 4,800 Gauss 4,900 Gauss, 5,000 Gauss, and so on. In a particular embodiment, the flux density generated by the magnet or plurality of magnets is between about 500 Gauss and 4,000 Gauss. In still a more particular embodiment, the flux density generated by the magnet or plurality of magnets is between about 500 Gauss and 3,750 Gauss. In still yet another embodiment, the flux density generated by the magnet or plurality of magnets is between about 500 Gauss and 3,500 Gauss. In yet still another embodiment, the flux density generated by the magnet or plurality of magnets is between about 1,000 Gauss and 3,500 Gauss.

The magnetic elements are magnets used with the helmet described herein may be any conceivable shape (e.g., circular, parabolic, concave, convex, polygonal, such as a triangular, square, pentagonal, hexagonal, octagonal shape, etc.).

In a particular aspect, the at least one magnet is circular. In embodiments where the at least one magnet is circular, the magnet can have a diameter between about 0.1 inch to about 3 inches, e.g., such as 0.1 inch, 0.2 inches, 0.3 inches, 0.4 inches, 0.5 inches, 0.6 inches, 0.7 inches, 0.8 inches, 0.9 inches, 1.0 inch, 1.1 inches, 1.2 inches, 1.3 inches, 1.4 inches, 1.5 inches, 1.6 inches, 1.7 inches, 1.8 inches, 1.9 inches, 2.0 inches, 2.1 inches, 2.2 inches, 2.3 inches, 2.4 inches, 2.5 inches, 2.6 inches, 2.7 inches, 2.8 inches, 2.9 inches, 3.0 inches, and so on. In a particular embodiment, the diameter of the at least one magnet is between about 0.5 inches and about 2.0 inches. In still a more particular embodiment, the diameter of the at least one magnet is between about 1.0 inch and about 2.0 inches. In still yet another particular embodiment, the diameter of the at least one magnet is about 2.0 inches In another particular aspect, the at least one magnetic element is disk shaped with cup-shaped shielding. For example, the magnet can be disk shaped and contained in a cup of ferromagnetic shielding material.

Further, the at least one magnet suitable for the helmet described herein can have a thickness between about 0.1 inch to about 3 inches, e.g., such as 0.1 inch, 0.2 inches, 0.3 inches, 0.4 inches, 0.5 inches, 0.6 inches, 0.7 inches, 0.8 inches, 0.9 inches, 1.0 inch, 1.1 inches, 1.2 inches, 1.3 inches, 1.4 inches, 1.5 inches, 1.6 inches, 1.7 inches, 1.8 inches, 1.9 inches, 2.0 inches, 2.1 inches, 2.2 inches, 2.3 inches, 2.4 inches, 2.5 inches, 2.6 inches, 2.7 inches, 2.8 inches, 2.9 inches, 3.0 inches, and so on. In a particular embodiment, the thickness of the at least one magnet is between about 0.5 inches and about 1.0 inch. In still a more particular embodiment, the thickness of the at least one magnet is between about 0.5 inches and about 0.75 inches. In still yet another particular embodiment, the thickness of the at least one magnet is about 0.5 inches. If more than one magnet is used in the helmet as described herein, in certain embodiments, the shapes and thicknesses of the magnets may be the same or different depending on the SMMF/array to be achieved.

Further still, the at least one magnet suitable for the helmet described herein can have a weight between about 0.1 lb. (pound) to about 3.0 lbs., e.g., such as 0.1 lb., 0.2 lbs., 0.3 lbs., 0.4 lbs., 0.5 lbs., 0.6 lbs., 0.7 lbs., 0.8 lbs., 0.9 lbs., 1.0 lb., 1.1 lbs., 1.2 lbs., 1.3 lbs., 1.4 lbs., 1.5 lbs., 1.6 lbs., 1.7 lbs., 1.8 lbs., 1.9 lbs., 2.0 lbs., 2.1 lbs., 2.2 lbs., 2.3 lbs., 2.4 lbs., 2.5 lbs., 2.6 lbs., 2.7 lbs., 2.8 lbs., 2.9 lbs., 3.0 lbs., and so on. In a particular embodiment, the weight of the magnet used in the helmet described herein is between about 0.5 lbs. and about 2.0 lbs. In embodiments, the weight of the magnet is between about 0.5 lbs. and about 1.5 lbs. In still yet another particular embodiment, the weight of the magnet is about 1.5 lbs.

In another particular embodiment, the total weight of the magnet or plurality of magnets disposed on the helmet described herein is between about 0.5 lbs. and about 2.0 lbs. In still a more particular embodiment, the total weight of the magnet or plurality of magnets disposed on the helmet described herein between about 0.5 lbs. and about 1.5 lbs. In still yet another particular embodiment, the total weight of the magnet or plurality of magnets disposed on the helmet described herein is about 1.5 lbs.

If more than one magnet is used in the helmet as described herein, in certain embodiments, the shape, thicknesses, weight, strength, diameter, power, etc. of the magnets may be the same or different depending on the array specifications needed to generate a particular SMMF.

Characteristics and specifications representative of magnets that may be suitable for embodiments described herein are provided in FIGS. 5A-5D. FIG. 5A illustrates the attractive and repulsive forces generated by magnetic discs, which are axially magnetized. FIG. 5B shows a photograph demonstrating the relative size of an individual neodymium grade N52 magnet identical to those used in the studies discussed herein. FIG. 5C illustrates the dimensions and specifications for a magnet suitable for the helmet disclosed herein and shown in FIG. 5B (manufacturer, K&J Magnetics, Inc.). FIG. 5D is a graph depicting the repulsive force generated by two N52 magnets (manufacturer, K&J Magnetics, Inc.) with like poles (N,N) facing each other.

Magnet Configuration

The magnets described herein can be affixed to the helmet using methods well known in the art (e.g., the magnets can be glued, screwed, frictionally engaged within the helmet, magnetically attached to the helmet, encased or nested within magnet cavities or pouches, etc.).

Permanent rare earth magnets, however, such as those containing neodymium, are metallic but they do not have the strength of alloys such as steel, and need to be affixed to the helmet appropriately because they are brittle. This physical property of the neodymium magnets should be considered in the design of helmets given the brittleness of the neodymium alloy material. The extreme force applied to a small area, undistributed over the surface area of the magnet, shatters the magnet. Thicker, flatter discs would be less prone to shattering with a hard sharp impact, but the magnets contemplated for embodiments described herein are curved and molded into the insides of the helmet shell so that they exactly fit the interior contours of the shell. Because the thickness would be on average about ½ inch, and sometimes thinner for helmets designed for children, these magnets would be more susceptible to fracture.

As shattered magnets would fail to provide protection from subsequent impacts, configuration of the magnets should be considered. Extremely powerful magnetic fragments that have sharp edges could dislodge from the helmet and cause significant injury as they fly away from one another or towards one another, resulting in lacerations and other tissue injuries in the wearer or others.

In order to maximize safety and minimize the chance of the magnets shattering, in a particular embodiment of the helmet disclosed herein, the magnets can be completely encased in the hard exterior shell of the helmet such that they could not be inserted or removed once the helmet left the factory. That is, the magnets would be disposed within the helmet and not along the exterior. By embedding the magnets into the hard shell, the shell acts as the initial force dissipater such that the force is spread more evenly over the surface of the magnet.

In embodiments, the shell of the helmet can be formed with a cavity of depth, width and shape to accept the magnetic elements. In a particular aspect, one or more cavities may be formed on the exterior of the helmet, the interior of the helmet, encased within the shell of the helmet, or formed on both the exterior of the helmet and the interior of the helmet for receipt of the at least one magnet.

In a particular aspect, one or more cavities are formed on the exterior of the helmet for receipt of the at least one magnet. Helmets according to this aspect may further comprise a material to coat/cover the externally placed magnets to protect them from damage.

In a more particular aspect, one or more cavities are formed on the interior of the helmet for receipt of the at least one magnetic element. Helmets according to this aspect may further comprise a material to coat/cover the externally placed magnets to protect them from damage. In still a more particular embodiment, one or more cavities are formed on the interior of the helmet between the outer shell and the inner lining for receipt of the at least one magnet.

In another embodiment, the magnet is sealed into the cavity by affixing a cover over the inside surface of the cavity. The cover can be affixed according to known methods in the art (e.g., fixation such as securing by an adhesive and/or molded plastic or metal parts secured permanently to the interior surface of the helmet's polycarbonate shell by screws, fasteners, brads, adhesives, hook and loop type fasteners, soldering, welding, etc.).

In some embodiments, the cover is comprised of ferromagnetic material such as steel. In other embodiments, the cover is a ferromagnetic steel cup. The steel cups may be threaded on the outside and the cavity can be threaded on the inside such that the cup could be screwed into the cavity as a flush-mounted unit. In this embodiment, the magnet may be held in the metal cup by way of its own attraction to the metal, or alternatively it may also be secured by an adhesive. This embodiment has the advantage that the magnets could be removed and inspected for fractures and damage. In instances of damage, those magnets could be replaced and the rare earth neodymium in the fractured magnets could be recycled.

In still yet another embodiment an additional force dissipater may optionally be inserted between the one or more cavities or pockets or gaps between the exterior surface of the magnet and the hard shell into which the magnet element is embedded and/or affixed for added protection to the magnet. Non-limiting examples of materials suitable for additional force dissipation include elastic materials, gels, fluids, foams, rubbers, and the like. In one embodiment, the exterior shell is molded with cavities sufficient to hold the plurality of magnets in their preferred locations and further comprises a force dissipating material wherein the at least one magnet is sealed into the cavity or pocket in the hard molded plastic shell. In the preferred embodiment the at least one magnet is completely sealed in a cavity within the polycarbonate shell, and is completely encased in polycarbonate. In a particular embodiment, the at least one magnet is movable within its cavity or pocket. In these embodiments, the cavity is filled with a fluid, gel, foam, etc. to protect the magnet from damage. More particularly, in an embodiment, an exterior shell is molded with cavities sufficient to hold the plurality of magnets in the preferred locations, and a colored fluid or gel is applied to the cavity prior to insertion of the magnet. The magnet is sealed into the cavity or pocket in the hard molded plastic shell. A clear plastic window or portal covers at least one portion of the magnet on the interior shell such that the interior surface of the magnet can be seen when looking inside the helmet, under the liner. In this embodiment, the colored fluid or gel serves the purpose of 1) providing additional force dissipation between the hard shell and the magnet, and 2) in the event that the magnet fractures, the fluid would leak from the outside compartment thru the cracks in the magnet, and become visible through the clear window. Thus, even though the magnet(s) would be completely enclosed in an embedded system and not removable, the wearer would be able to check magnet integrity by the presence of colored fluid in the window. This enhances safety because if the magnets need to be removed in order to check for integrity, serious injuries could result, including crushing of bones in the fingers and hands. If the magnets were attracted to metal or another magnet and a body part were caught between it, the hundreds of pounds of force could cause crush injuries or even potentially avulsions.

Magnetic Field Manipulation

The shape of a magnetic field can be sculpted by the arrangement, shape, strength, and polarization of magnetic elements in proximity to one another, for example, in a composite, an array, or by magnetic shielding placement. This sculpting of magnetic fields is termed spatially modulated magnetic field or SMMF. In particular embodiments, the helmets described herein can be designed with complementary spatially modulated magnetic fields or arrays in the impact zones of the two helmets such that (1) the shape of the fields produced by the arrays still allows for repulsive force between the two helmets; (2) the helmets, when brought into opposition, would seek the lowest energy state wherein the respective spatially modulated magnetic fields can fit together to prevent the rapid sliding vector change (termed laminar motion) which would produce a neck injury; and (3) the spatially modulated magnetic fields can be configured such that when the edges of magnets in opposing helmets approach one another, the attraction is minimized such that the helmets repel and preferably do not stick together.

In particular embodiments, a helmet system comprising two helmets could be designed such that the first helmet has a particular spatially modulated magnetic field (e.g., the magnetic element on the opposing forehead regions of two helmets) assumes a cupped (concave) shape and the second helmet has a corresponding bulge (convex) shape, such that when the spatially modulated magnetic field of the first helmet and the spatially modulated magnetic field of the second helmet are brought together in opposition, they repel one another, but also "fit" together in complementary shapes much like a ball-hitch. This could be accomplished by using either composite magnets in a magnetic element or corresponding arrays of magnets in a magnetic element on the two helmets.

Figure 21A:
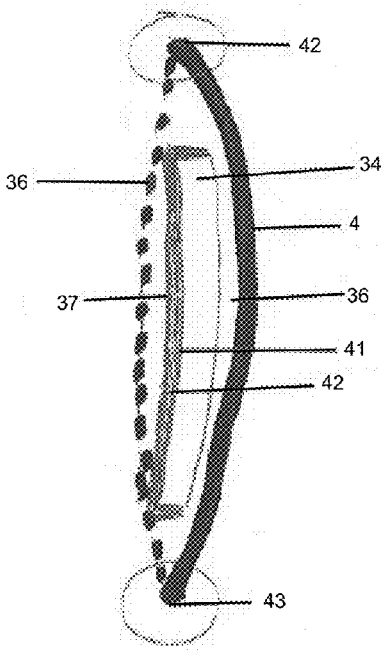
FIGS. 21A-21C are schematics showing various embodiments and configurations for magnets that can be used with the helmets and helmet systems of the invention.
Figure 21B:
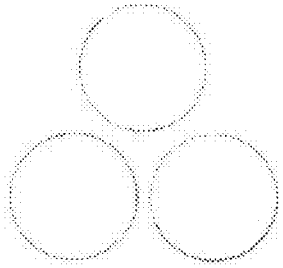
Figure 21C:
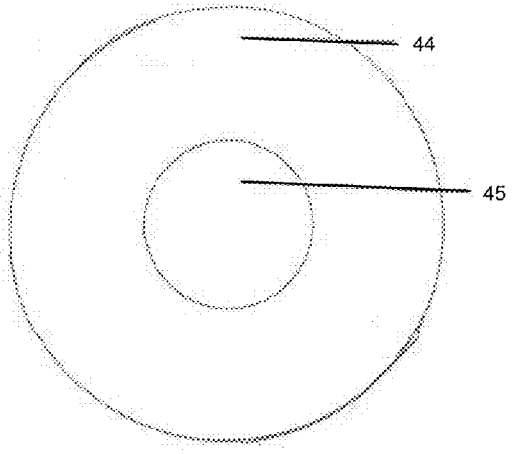

In another embodiment, the helmets may comprise composite discs (as represented in FIGS. 21A-21C) wherein on the one helmet, a strong "donut" would have a weaker magnet affixed in the "donut hole", or a magnet in the "donut hole" that has a different axis of orientation to the "donut".

On the other helmet, the corresponding magnetic element would contain a comparatively weaker "donut" and a stronger "donut hole".

Figure 18:
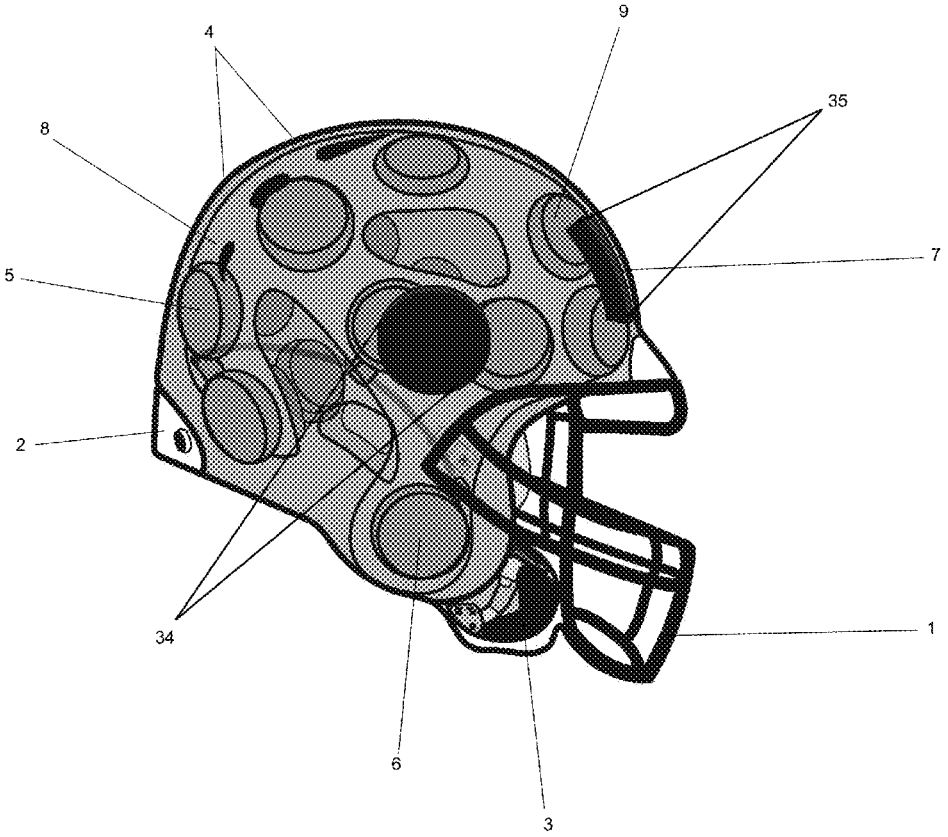
FIG. 18 is a schematic illustration showing the helmet of FIG. 4C with a lateral magnet or magnetic array placed on both the right and left sides of the helmet and frontal magnet or magnetic array placed at the frontal forehead position.

In particular, FIG. 21A illustrates a detailed cross sectional view of the lateral magnets/magnetic array represented in FIG. 18 as (34). The magnet (35) is enclosed in a pocket within the outer polycarbonate shell lining. The magnet (35) may be a disc or may follow the curvature of the helmet. It may be modified with impact absorbing padding and magnetic shielding as with magnet (35) shown in FIGS. 20A-D.

Figure 14:
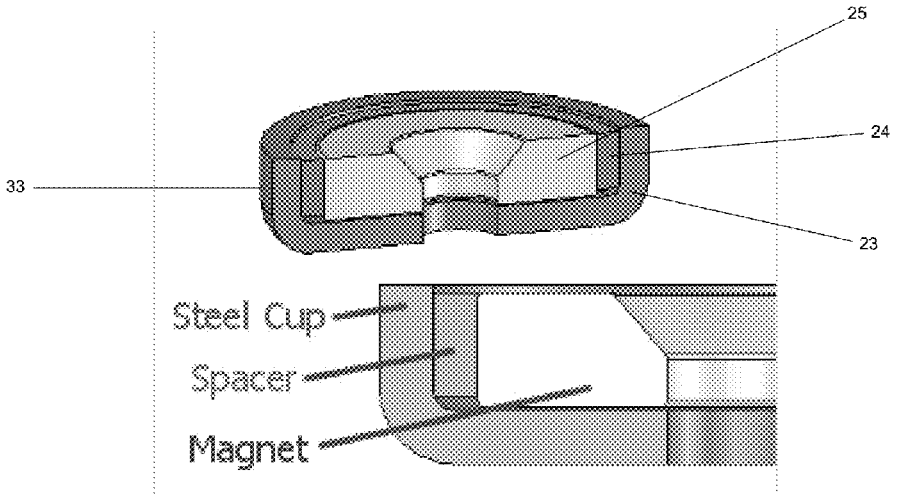
FIG. 14 is a schematic illustration showing placement of a disc-shaped magnet into a steel cup with an impact-absorbing spacer between the brittle magnet and the cup.
Figure 15:
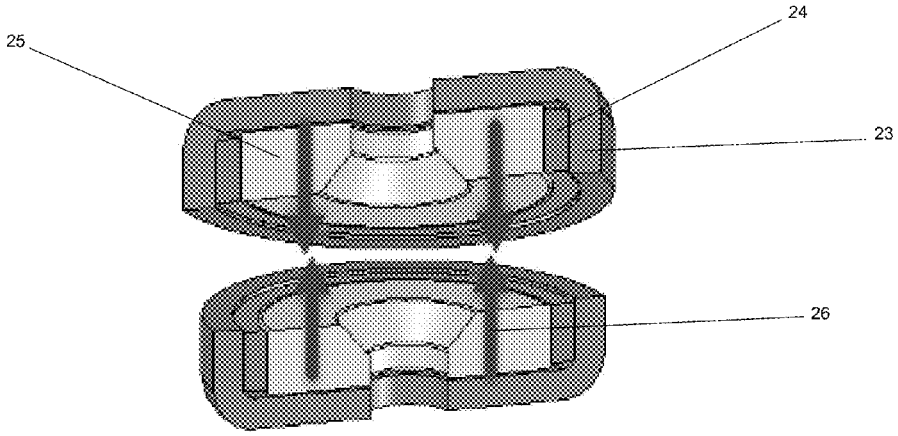
FIG. 15 is a schematic illustration showing the SMMF of two opposing cupped magnets and the directionality of the shaped magnetic field.
Figure 16:
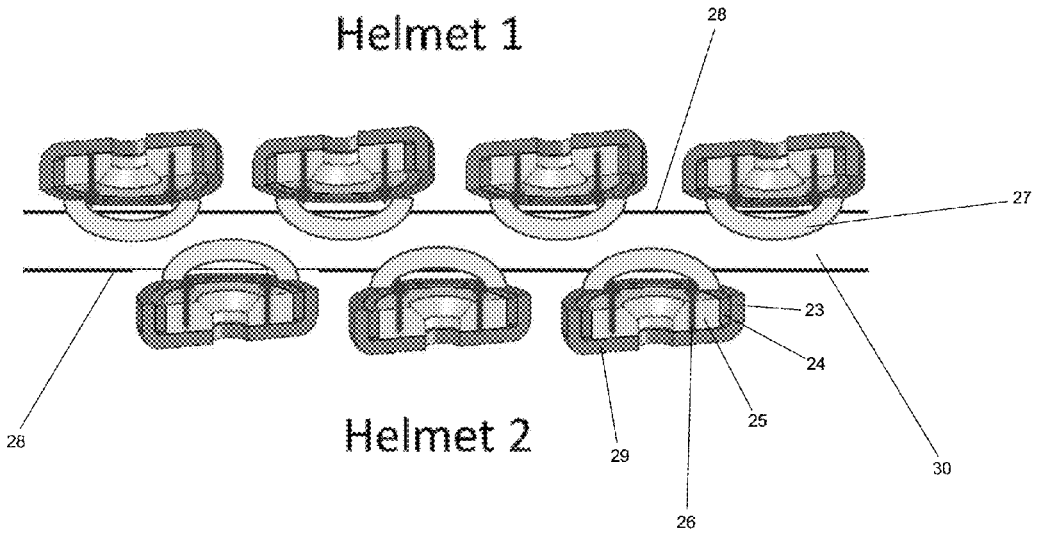
FIG. 16 is a schematic illustration showing two opposing arrays of cupped magnets arranged at an offset in an "egg-crate" pattern in two opposing helmets.

FIG. 21B shows that the magnet/magnetic array (see FIG. 18, (34)) may be comprised of an array of 3 or more small magnetic elements that may be substantially similar to those shown in FIGS. 14, 15, and 16. Each circle represents a magnetic array element; however, it will be appreciated that any shape of disc that may be axially magnetized could be used, in any combination with other shapes. FIG. 21C illustrates that the individual magnet(s) may be whole magnets or composite magnets. In a composite magnet one component (44) may differ from another component (45) by magnetic field strength or direction. The components of the composite magnetic element are affixed to one another by means known to those familiar with the art. Flat Halbach discs are a type of composite magnet not specifically pictured here that may comprise magnets (34) individually or in an array.

The spatially modulated magnetic fields of these opposing composite magnets could be further modified by ferromagnetic backing or cupping. Another non-limiting example would comprise an array of at least 3 magnetic elements in close proximity such that an "egg crate" spatially modulated magnetic field or array is generated (see FIGS. 16 and 21B) wherein the opposing spatially modulated magnetic fields would decelerate an impact without causing rapid laminar motion since the magnetic fields are "flatter" and "bumpier". The configuration and design of magnetic elements in our helmets would be superior to a helmet design with a single magnet with no specially shaped and engineered spatially modulated magnetic field because the engineered spatially modulated magnetic fields employed with the disclosed helmet would decelerate the impact, reduce collision force, and/or resist both laminar motion that causes neck injuries, as well as prevent the sticking together of helmets which would also cause neck injuries.

In another embodiment, the spatially modulated magnetic field configuration of the two helmets in the system are arranged to prevent hard impact but, in certain embodiments, also guide the helmets into a positional configuration that minimizes or prevents rotation and force vector change to laminar motion of the helmets with respect to one another.

Figure 13:
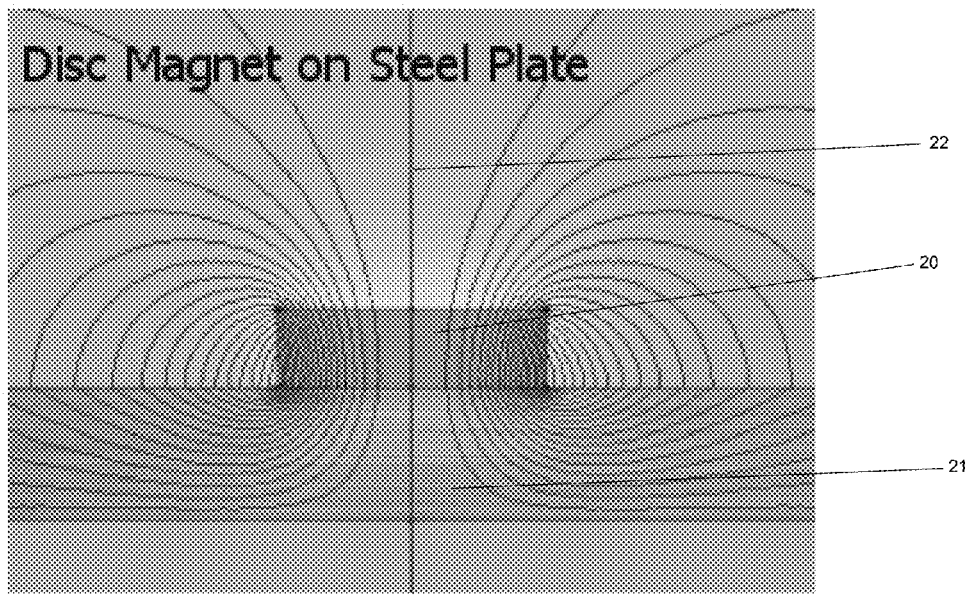
FIG. 13 is a schematic illustration showing the shape of a magnetic field of an axially magnetized disc magnet by placement on a ferromagnetic shield material.

In still additional embodiments, the spatially modulated magnetic field may also be shaped by magnetic shielding of parts of a magnet by ferromagnetic materials. Any material suitable for magnetic shielding may be used. In particular embodiments the material used for magnetic shielding is a ferromagnetic material or metallic alloy thereof. Non-limiting examples of materials suitable for magnetic shielding include any ferromagnetic material containing iron (Fe), nickel (Ni), cobalt (Co), stainless steel, brass (such Ni/Ti coated brass), NiCo alloys, NiFe alloys, NiFeCo alloys, NiFeMo alloys, NiFeCuMo alloys, and the like. In particular embodiments, one or more metal alloys termed "Mu-metals" are the magnetic shielding materials. Mu-metals are a type of NiFe alloy, particularly effective at magnetic shielding. The magnetic shielding material may take the form of sheet metal, foil, wrappings, coatings, or cups depending on the application. FIG. 13 illustrates the change in magnetic field as a steel plate redirects the lines of force of a disc magnet resting on the plate. Steel saturates at about 22,000 Gauss and mu-metals saturate at about 8,000 Gauss. Placing a magnet upon ferromagnetic shielding does two things: (1) it amplifies the strength of the magnetic field on the side opposite the magnetic shielding, and (2) it redirects the magnetic force in a direction away from the magnetic shielding. Thus, magnetic shielding can be used to sculpt SMMF for various applications.

In particular embodiments, it is envisioned that the helmet described herein may utilize ferromagnetic shielding behind the magnetic elements or cupping of the magnetic elements in order to boost field strength, eliminate the attraction of opposing discs when the sides of the discs are brought into opposition, and/or potentially reduce the weight of the helmet by enabling use of smaller thinner magnetic elements.

Ferromagnetic shielding of the magnetic elements would be accomplished by "cupping" in our preferred embodiment (see FIGS. 14 and 15). Cupping a disc magnet in steel or other ferromagnetic material eliminates the side to side attraction and directs the magnetic field outwards away from the bottom of the ferromagnetic cup. In embodiments, the at least one magnet may be held in the metal cup by way of its own attraction to the metal, or alternatively it may also be secured by an adhesive. Cups and magnets may assume any shape; non-limiting examples would be discs, rings, polygons, (e.g., triangular, square, rectangular, hexagonal, octagonal, etc.) and the like. Any commercially available axially magnetized magnet can be used to the same effect to modulate SMMF and overcome shortcomings of current technology (see FIGS. 13, 14, and 15 depicting a ring magnet and representing one possible configuration). Furthermore, spacer material in the cupped magnetic elements could be left out in some embodiments; in other embodiments the spacer material could be comprised of materials known in the art (e.g., rubber, plastic, other polymers, foam, padding with air cells, gel, combinations thereof, etc.).

In addition to shaping the spatially modulated magnetic fields by magnet size, strength, axis orientation, and shielding, the arrangement of magnets with respect to one another can also influence the shape of a magnetic field and thus the interaction of opposing magnetic fields. In certain embodiments, the spatially modulated magnetic field is a particular SMMF generated by a Halbach array. In particular embodiments, at least one magnetic element on the helmet comprises a Halbach array. Halbach arrays are arrays of magnets arranged such that the magnetic flux is distributed on one side of the array. In the Halbach array the special arrangement of permanent magnets makes the magnetic field on one side of the array stronger, while canceling the field to near zero on the other side. Unlike the magnetic field around a single magnet, there is an equal strength magnetic field on either side of the magnet with a Halbach array. The composite magnet shown in FIG. 17 has 5 cubes arranged in a Halbach array, and the arrangement of the north poles within the composite magnet results in the north magnetic field going in the indicated direction. Magnetically, this is in effect a single long magnet and may be termed a "flat" Halbach array. Halbach arrays may also be constructed of cylinders and rings. Halbach arrays can also be configured in many shapes depending on the shape of the SMMF desired. A ring magnet with multi-pole magnetization, or a ring made up of smaller arc segments can be used in this way. Different magnet configurations will yield different directions and strengths of the magnetic field within the hole. FIGS. 20A-20D illustrates a modified design wherein a plurality of magnets are configured in an arced Halbach array such that the magnetic flux would approximate a Halbach flux distribution that would point "up" out of the plane of the page (e.g., project along the z-axis); such a modified Halbach array can be useful as the magnetic element in the forehead or temporal placement in the helmet design. Halbach arrays useful to the helmets described herein may be constructed by any method known to those familiar with the art.

Figure 20A:
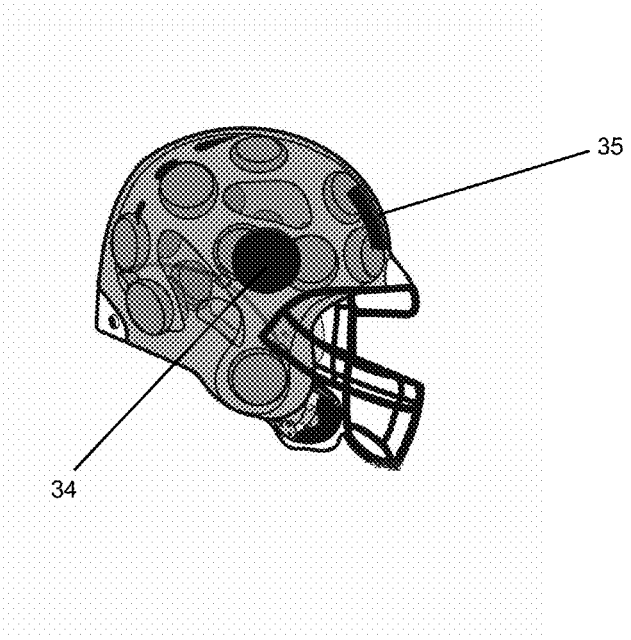
FIGS. 20A-20D are schematic illustrations showing various Halbach arrays incorporated into a helmet.
Figure 20B:
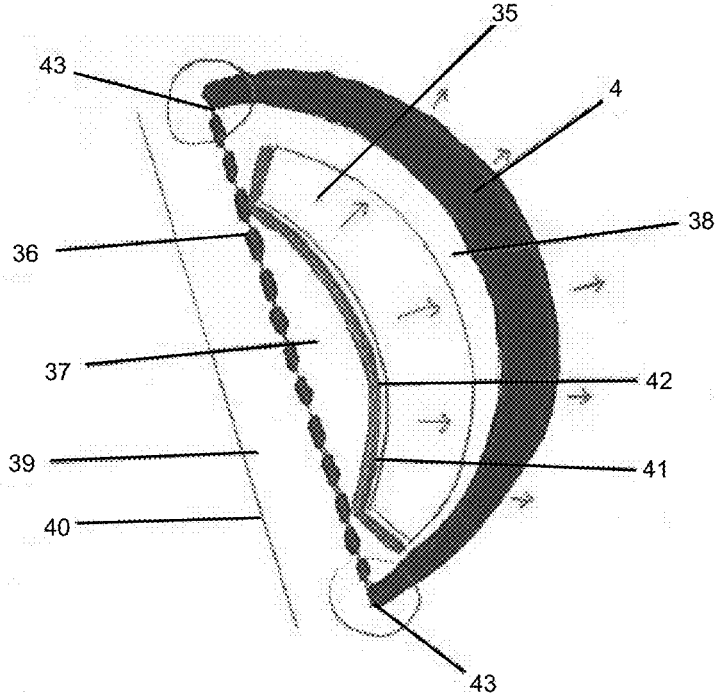

In particular, FIG. 20A provides a view of the magnets (35) and (24) in situ in a modified helmet. FIG. 20B is an exploded cross sectional view of the magnet (35) provided in FIG. 18. The polycarbonate helmet exterior (4) and/or an interior enclosure (36) may be comprised of polycarbonate or another substance joined together (43) to form a pocket or enclosed protected space (37 and 38) behind and in front of (respectively) the magnet (35) which may be a single magnet, a composite magnet, or an array of magnets. The enclosed magnet (35) may be fully or partially surrounded by or coated by an impact absorbing material (41) analogous to that shown in FIG. 15 as impact-absorbing space (24). Further, the magnet (35) and padding (41) may, optionally, be cupped in a ferromagnetic shielding material (42) such as steel or mu-metal. Lines of magnetic field force are denoted as arrows. Space between the outer helmet in which the magnetic array is situated and the inner helmet liner (40) is designated by (39). Space (39) may optionally contain additional padding elements not provided FIGS. 20A-20D. The padding elements may be affixed to interior surface of outer polycarbonate shell or to the inner liner (40).

Figure 20C:
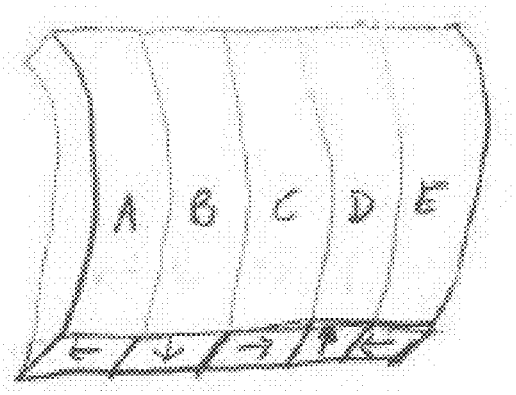
Figure 20D:
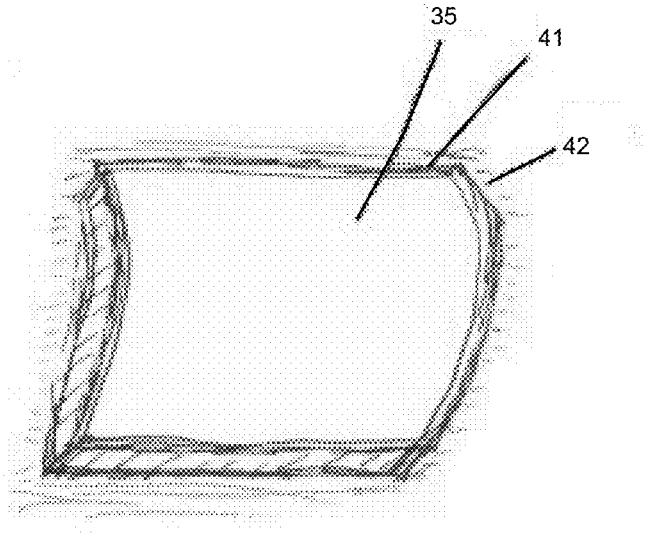

FIG. 20C shows an alternative embodiment illustrating a curved magnet as a modified Halbach array with 5 magnetic elements (A-E) affixed together into a solid arc with a magnetic axis depicted by arrows pointing to the north. This array is a modification of the Halbach arrangement illustrated in FIG. 17A and the magnetic field curves upward out of the plane of the page (e.g., along the z-axis), corresponding to force that would be projected through the front of the helmet and towards the helmet of an opposing player. FIG. 20D is a frontal view of element (35) as embodied in FIG. 20B. The magnet of FIG. 20D is partially enclosed in an impact absorbing layer of material (41) and this is further backed or cupped by a magnetic shielding material (42) shown as gray cross-hatch, which may be comprised of a material as described herein.

The magnetic elements in this design, cupped or uncupped, may be affixed to the polycarbonate shell in a number of different ways.

Regarding magnet placement and contre coup, in a particular embodiment, 3 magnets and/or arrays of magnets are disposed in or on the helmet in the 3 locations that are most likely to be hit by another player and result in a concussion in contact sports; these are the front of the head (forehead), and both sides of the head. Permanent magnets are heavy and industry experts have estimated that no more than two pounds could be added to the weight of football helmets, or else they become too heavy and cumbersome for the players to wear.

In embodiments, at least 3 curved magnets or magnetic elements that match the curvature of the outer shell are disposed between the outer shell of the helmet and the inner lining. In still a more particular embodiment, at least 3 curved magnets that match the curvature of the outer shell are disposed between the outer shell of the helmet and the inner lining, wherein the magnets generate at least 125 pounds of repulsive force, weigh about ½ pound each, and would add no more than 1.5 lbs to the weight of the helmet. In another embodiment, the magnetic elements are disposed in or on the helmet and are contacted by a ferromagnetic shielding material such that the magnets weighing about ½ pound each would generate at least 200 pounds of repulsive force, and would add no more than 1.5 lbs to the weight of the helmet. In another preferred embodiment, the magnetic elements are disposed in or on the helmet and are contacted by a ferromagnetic shielding material such that the magnets weighing about ¼ pounds each would generate at least 125 pounds of repulsive force, and would add no more than 1.5 lbs to the weight of the helmet. In yet another preferred embodiment, the 3 magnets or magnetic elements are disposed in or on the helmet, such that during use the magnets are disposed at the forehead and both sides of the head (corresponding to the temporal area of the skull) between the outer shell of the helmet and the inner lining of the helmet.

The fourth site of impact that most frequently results in concussion is the rear of the head. However, it will be appreciated by one who watches or plays contact sports that players do not receive concussions by the collision of the back of one player's head into the back of another player's head. Rather, concussions from blows to the back of the head occur most frequently when players are knocked down and the back of the head hits the ground with great force. In an embodiment a shock absorber would be located in the rear of the helmet, preferably beneath the hard outer shell. This shock absorber or system of shock absorbers could take the form of a cushion made from elastic material or encapsulated gel, a magnetic "piston", or a magnetic shock-absorbing cell similar to the cell described in U.S. Pat. App. Pub. No.: 2013/0125294, which is incorporated by reference herein in its entirety.

In a particular embodiment of the helmet described herein, coup and rotation is minimized by the placement of magnets and thus configuration of SMMF by the outwardly facing magnets. Simultaneously, counter-coup is minimized on the opposite side of the head by a system of shock absorbers that may take the form of magnetic cells as described in U.S. Pat. App. Pub. No.: 2013/0125294. In fact the prevention of coup/countercoup injury may comprise different sets of magnets on opposite sides, or the magnet or set of magnets that prevents coup may be the same system that prevents countercoup due to its configuration. The system of shock absorption on the opposite side of the helmet from the coup may also be an elastic material or an encapsulated gel.

Systems

It should be appreciated that for team contact sports, all members of one team that will be facing off with the other team must wear the same type of helmet, and the opposing team must all wear the second type of helmet. As a simplified and non-limiting example, if one team wears helmets with a concave SMMF profile, the other team would need to wear helmets with the corresponding convex SMMF profile in order to maximize injury prevention.

The use of a magnetically configured helmet that simultaneously reduces or prevents an initial impact event and resulting coup, reduces or prevents countercoup, and reduces or prevents rotation and neck injury by way of an SMMF configuration is desirable. It will be appreciated that complete prevention of contact is not necessary for the successful operation of this invention. In certain embodiments, initial coup impact may be completely prevented. In other embodiments, initial coup impact force may be lessened by the SMMF. Since the exact amount of force to produce a TBI in a given human being is unknown and may vary significantly between individuals due to physiological differences, it will be appreciated that any significant reduction in impact force would lower the chance of incurring a TBI in a given instance of impact. Thus, in embodiments, provided is a system of 2 magnetic helmet devices for prevention of head and neck injury in two players wherein the force of impact of the devices is lessened at least 20% compared to the force of impact of the same helmets in their unmodified configuration (lacking magnets and/or an appropriately designed SMMF).

EXAMPLES

Example 1: Determining the Strength of Repulsive Forces

The strength of the repulsive force of these magnets, as it relates to distance was measured. Specifically, the repulsive force of two N52 disc magnets with like poles facing each other was determined at equal intervals, from the distance where repulsive forces can be detected to the point of near magnet contact.

FIGS. 7A-7D demonstrate how much repulsive force the magnets are able to exert at a given distance. Neodymium magnets (12) were fixed to a machine press (11) (see FIG. 7A) and like poles (N,N) were moved in increments of 0.25 inches toward each other. Force was measured in pounds with the use of an analog scale (13) that was placed beneath the lower magnet. Repulsive force generated in the one magnet system by the two opposed magnets 0.75 inches apart is approximately 40 lbs.

Figure 7A:
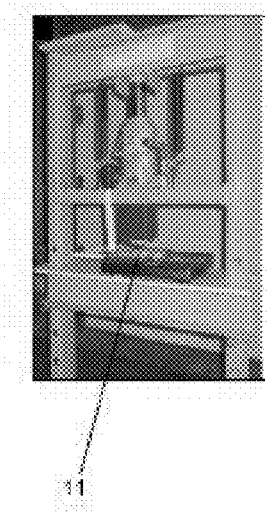
FIG. 7A is a photographic representation of the neodymium magnets pictured in FIG. 5B fixed to a machine press.
Figure 7B:
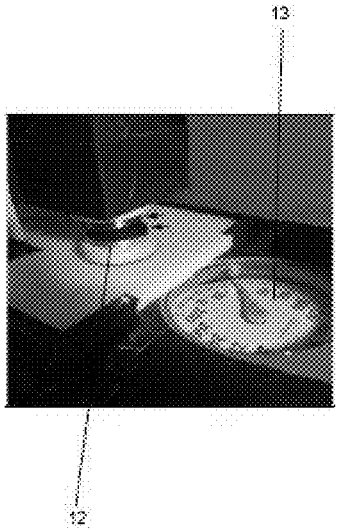
FIG. 7B is a photographic representation of the repulsive force generated in a single magnet system.
Figure 7C:
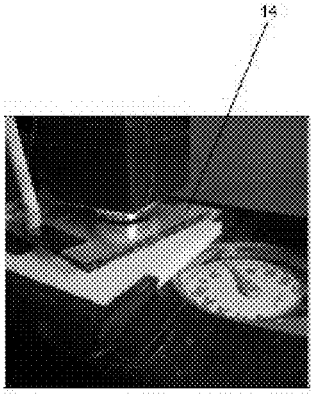
FIG. 7C is a photographic representation of the repulsive force generated in a multi-magnet system.

In FIGS. 7B-7C, the experimental design is the same, however, in the presence of two 3.5 mm polycarbonate sheets (14) placed between the magnets (this is equivalent to two outer polycarbonate shells of 2 opposing helmets). Notice that the repulsive force was not diminished by the presence of the polycarbonate.

FIG. 7D is a force graph showing the repulsive force (Y axis) of the one magnet system as a function of distance (lower line), and the two magnet system (2 magnets adjacent to each other above in opposition to 2 adjacent magnets below) upper line. These results are in close agreement with those generated by the manufacturer, K&J Magnetics, for this N52-graded magnet. In a similar experiment, we found that the repulsive force of two magnets lying adjacent to each other (upper line) was double that of those generated by the single magnet system (picture of 2 magnet system not shown).

Results indicated that two magnets, with a combined weight of only 13.6 ounces, can generate a repulsive force of 100 lbs when 0.5 inches apart.

Example 2: Determination of Whether Magnets can Reduce Impact Forces

Figure 8A:
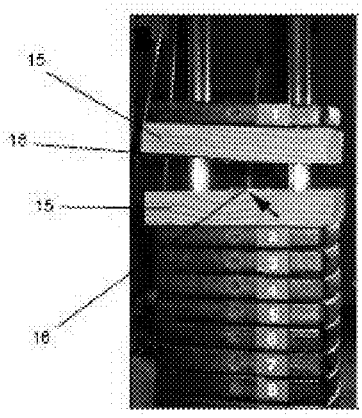
FIGS. 8A and 8B are photographic representations of a rig designed to measure the repulsive force of magnets.
Figure 8B:
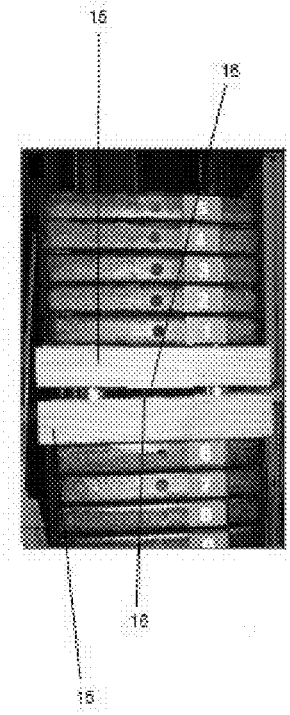
Figure 8C:
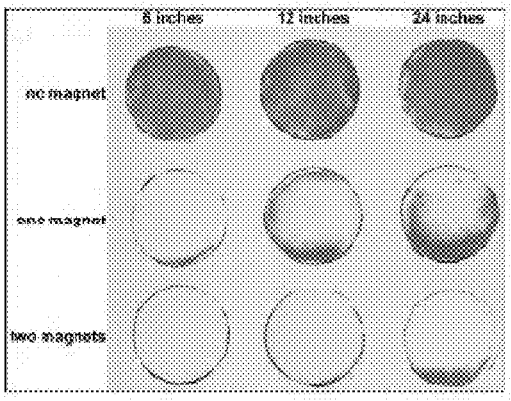
FIG. 8C is a photographic representation of pressure indicating film indicating the intensity of impact force.

To determine whether these magnets can reduce impact forces generated at a site of impact, magnet(s) were first secured in wood blocks adapted to slide smoothly on bars holding 10 lb metal weights (see FIGS. 8A and 8B). The repulsive force is generated by 2-inch diameter N52 magnets (single magnets with like poles facing each other with individual magnets (16) embedded in wooden chucks (15) on the rig shown in FIGS. 8A and 8B). Repulsive force was measured for both 10 lb (a) and 50 lb (b) stationary weights (each metal bar equals 10 lbs). The space between the two blocks of wood is the distance needed between two magnets (black arrow) to lift the corresponding weight. FIG. 8C shows a photograph of Fuji Prescale films placed between the magnets impacted by a 10 lb weight dropped from 6, 12, or 24 inches in the absence or presence of magnets. The experimental paradigm is comparable to current methodologies used to certify helmet safety and tested a weight that approximates the weight of an adult human head. The pressure indicating film used measures of 28-85 psi. These mylar based films are comprised of a monolayer of dye-filled microcapsules that, when impacted, rupture to reveal the distribution and magnitude of pressure between two impacting surfaces. This film was secured to the surface of the stationary magnet(s) and covered with 7 mm polycarbonate to match the thickness of the outer shell of two helmets. The presence of color/contrast indicates distribution and intensity of impact force, and shows that the repulsive force of magnets can dramatically reduce impact forces.

In comparison to the control (no magnets), the repulsive force of a single magnet produced a significant reduction in the impact force generated at all drop heights. This reduction was even more pronounced by two magnets.

Figure 9:
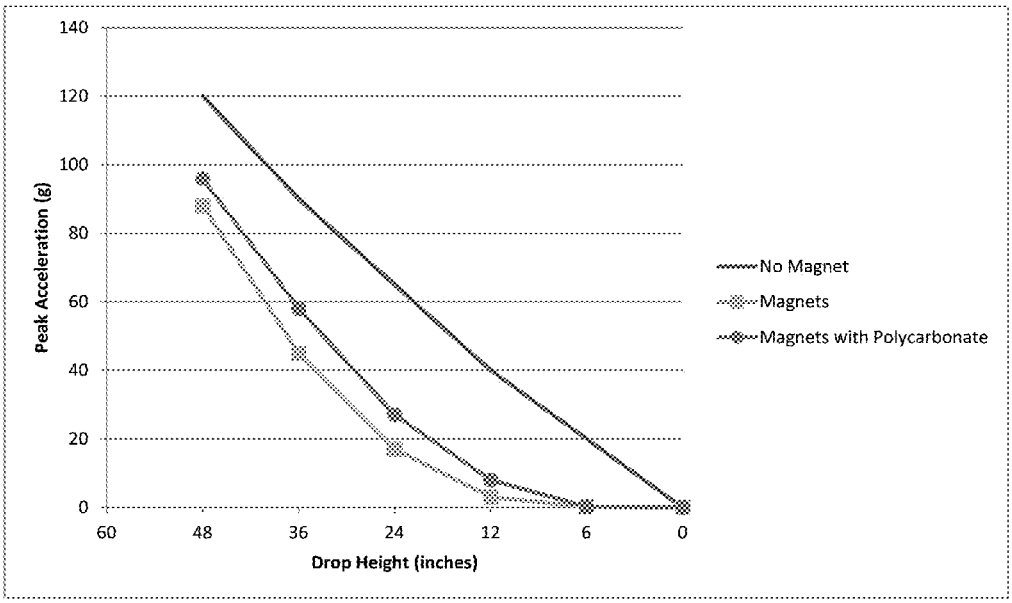
FIG. 9 is a graphical representation depicting the deceleration and impact force dampening shown by the experimental rig provided in FIGS. 8A-8B.

Example 3: Quantification of the Extent to which Magnetic Repulsion Reduces Forces at Impact Using the experimental rig shown in FIGS. 8A-8B, deceleration and impact forces were measured for the drop assay described above using an accelerator (Bruel and Kjaer 4533-B), which was mounted to the top of the moving weight, and attached to a hand-held analyzer (Bruel and Kjaer 2250). The accelerometer data was measured in $m/s^2$ and peak acceleration converted into g forces. As shown in the graph of FIG. 9, the solid line illustrates the peak acceleration with no magnet (negative control), the line with square data points illustrates peak acceleration with 2 pairs of opposing neodymium magnets, and the line with circle data points demonstrates the peak acceleration with 2 opposing pairs of magnets separated by 2 sheets of 3.5 mm polycarbonate. Table 1 shows numerical data from which the FIG. 9 graph is derived.

TABLE1

Quantification of Force Reduction at Impact
(g = number of g forces)

| | No Magnet | Magnet | Magnet with Polycarbonate |
|---|---|---|---|
| 0 inch | 0 g | 0 g | 0 g |
| 6 inches | 20 g | 0.2 g | 0.2 g |
| 12 inches | 40 g | 3 g | 8 g |
| 24 inches | 65 g | 17 g | 27 g |
| 36 inches | 90 g | 45 g | 58 g |
| 48 inches | 120 g | 88 g | 96 g |

Impressively, impact forces were reduced by >80% at the lower drop heights, 40% at the medium drop heights and roughly 25% at the highest drop heights. When these data are related to established on-field impact exposures data and their relative concussion risks, it suggests that the repulsive force of magnets could theoretically reduce the relative risk of concussions by up to 80% at all impact intensities. These preliminary studies clearly demonstrate that the repulsive force of magnets can be used to dramatically reduce forces generated at impact.

Example 4: Determining the Effect of a Barrier Between Two Magnets on Repulsive Forces This experiment addressed an important aspect of the implementation of magnets in existing football helmet designs, namely, that of magnet placement. In the helmet design phase, magnets would be secured directly to the inner surface of the polycarbonate shell and in front of the foam padding.

Figure 4A:
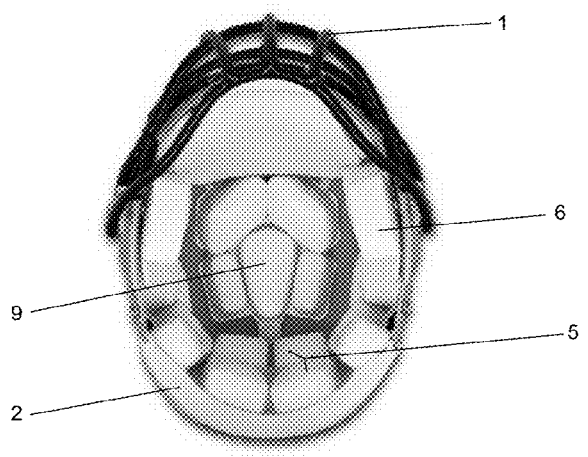
FIG. 4A (Prior Art)
FIGS. 4A-4C are illustrations of padding configuration for 3 popular and commercially available football helmets.
Figure 4B:
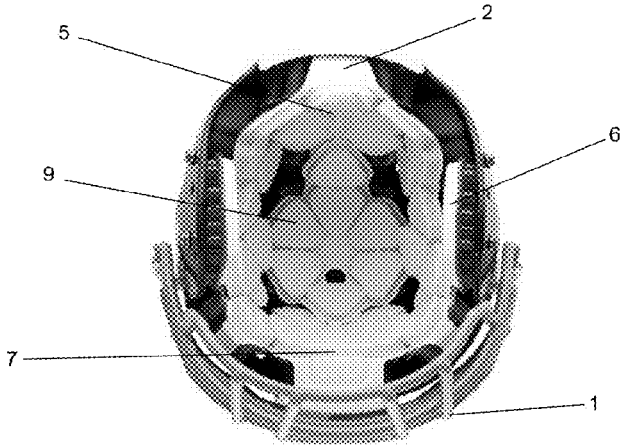
FIG. 4B (Prior Art)
Figure 4C:
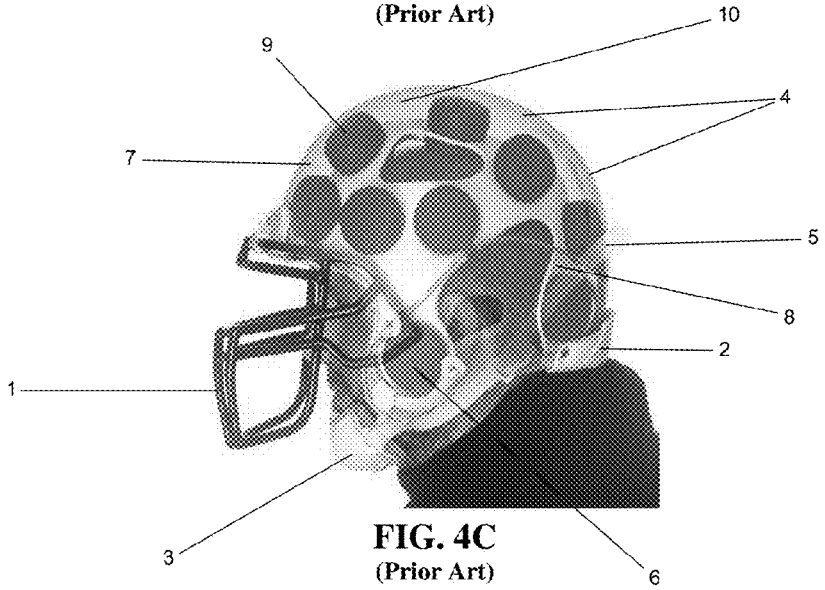
FIG. 4C (Prior Art)
Figure 19:
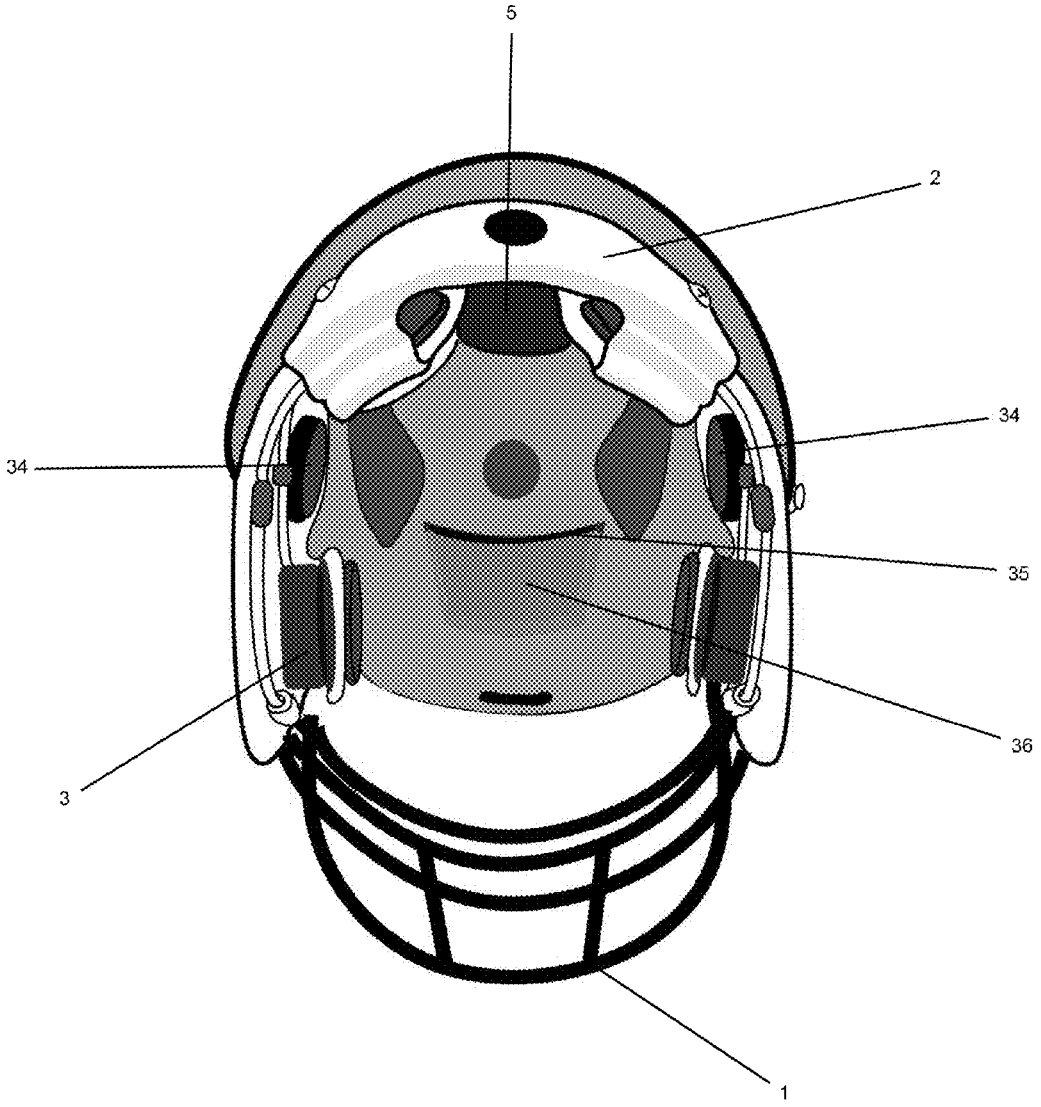
FIG. 19 is a schematic illustration showing the underside view of the interior of the helmet in shown in FIG. 18

FIG. 18 is an illustration of the helmet of FIG. 4C with lateral magnet or magnetic array placed at (34) on both the right and left sides of the helmet, and frontal magnet or magnetic array (35) placed at the frontal forehead position (7). FIG. 19 is an underside view of the interior of the helmet shown in FIG. 18. Lateral magnets or magnetic arrays represented by (34), frontal/forehead magnet or magnetic array represented by the dark line (35) situated and enclosed in the cavity in the polycarbonate shell represented by the darker shaded rectangular area labeled (36). The magnet or magnetic array is completely enclosed in the preferred embodiment but is illustrated thusly to allow the viewer to see a small portion of the magnet in the cavity which would be totally enclosed (36).

Accordingly, as the outer shell of a football helmet is made from 3.5 mm (0.138 inch) of polycarbonate we next sought to determine the repulsive force of two N52 separated by 7.0 mm polycarbonate between the two magnets, we found that there was no reduction in the repulsive forces of the two magnets (FIGS. 7A-D).

Figure 10:
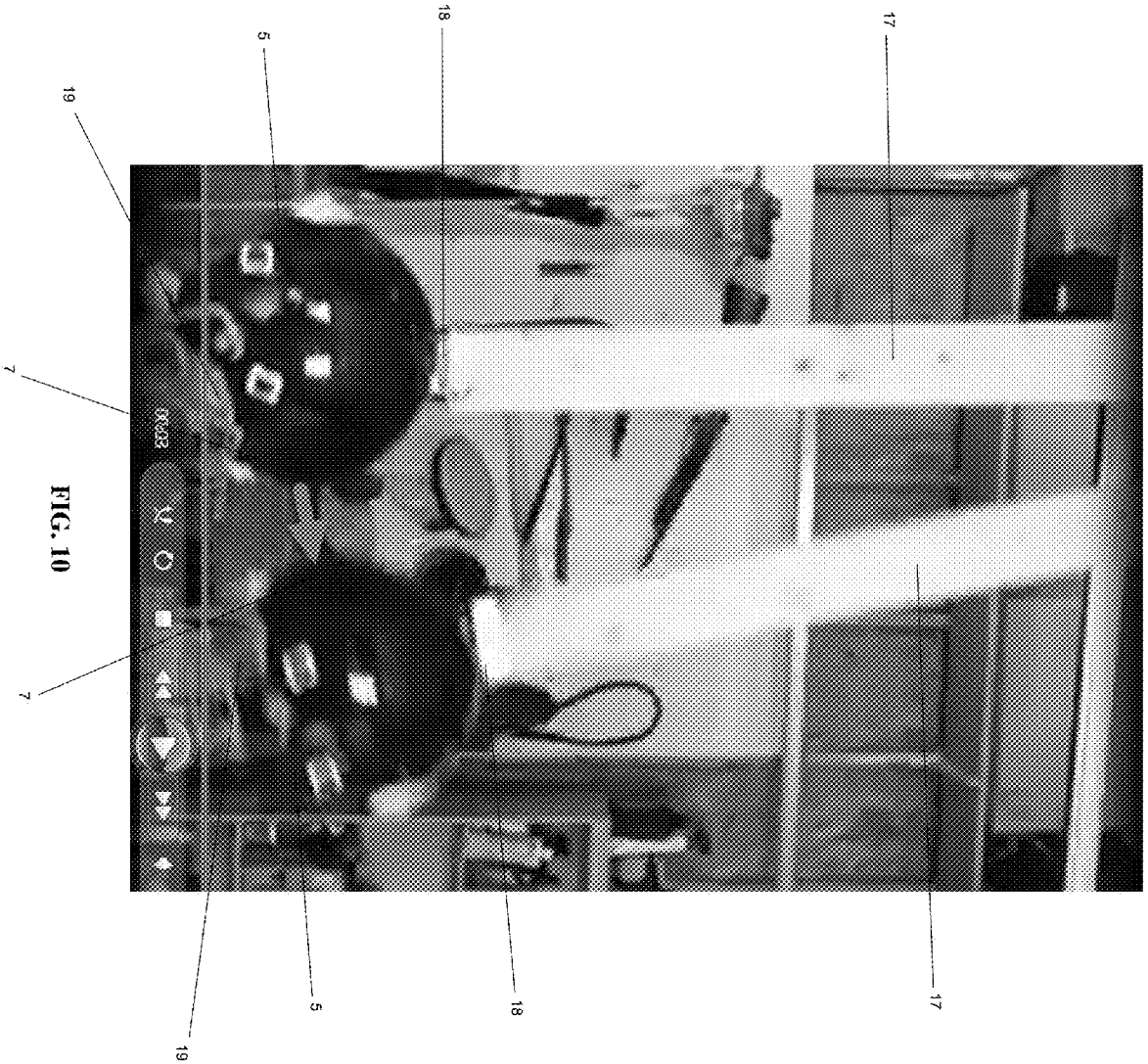
FIGS. 10 and 11 are photographic representations of a rig used for a pendulum acceleration test/assay.
Figure 11:
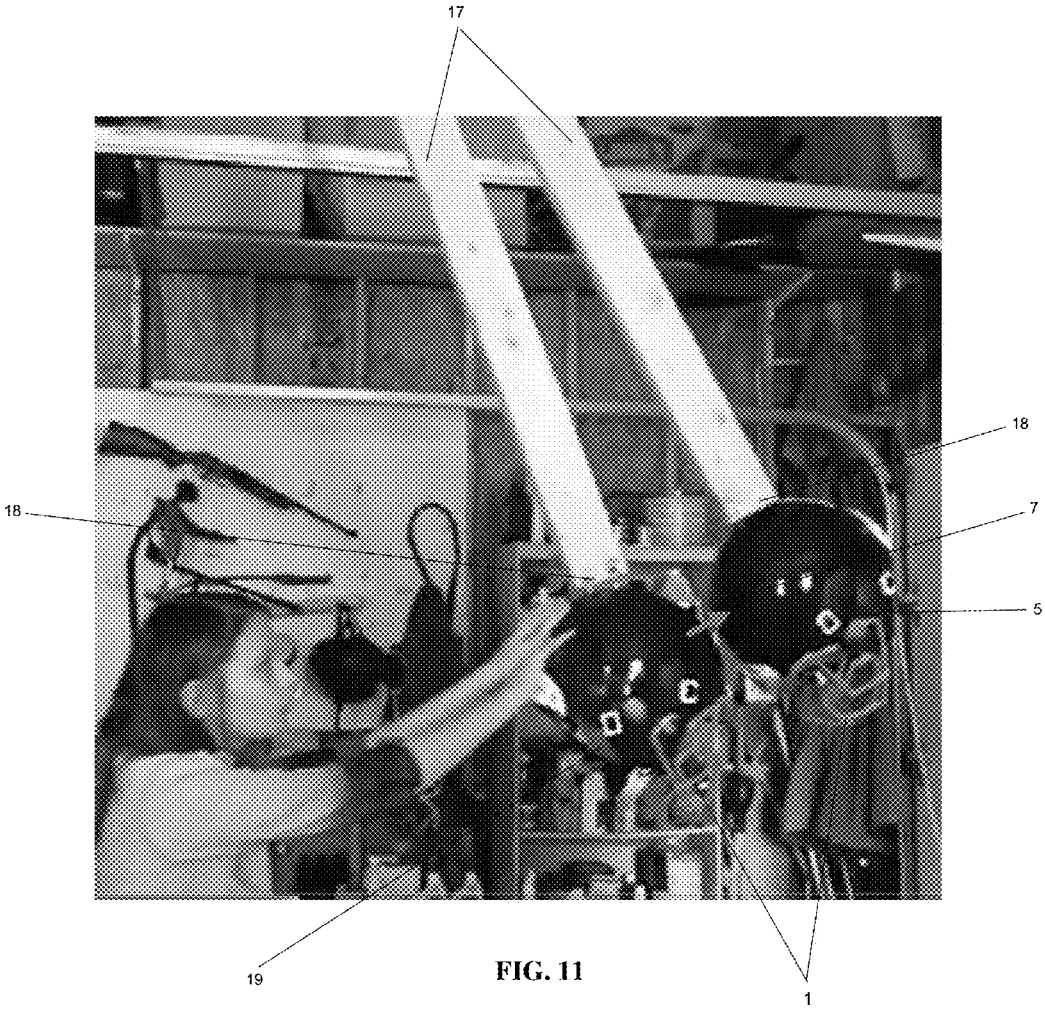

A test rig was built for a "pendulum assay." As shown in FIGS. 10 and 11, two helmets were specially modified with neodymium magnets secured underneath the polycarbonate outer shell in the forehead (frontal) region (see (7) in FIGS. 4A-4C). The occipital region (5) is labeled for perspective.

As illustrated in FIGS. 10 and 11, the modified helmets were attached at the top by metal brackets (18) to the pendulum arms (17) which were made of lengths of 2×4 lumber attached at the top of the rig (out of picture frame) such that they swung freely in a linear direction (up and down, not side to side). The helmets were attached to the respective pendulum arms facing one another forehead (7) to forehead (7) and each helmet contained a 10-pound medicine ball (19) to approximate the weight of a human head, and which can be seen as the object inside the helmets. The magnets cannot be seen because they are under the polycarbonate shell of the helmet's forehead (7) but the bold arrows point out the location of the magnets in the respective helmets.

Figure 12:
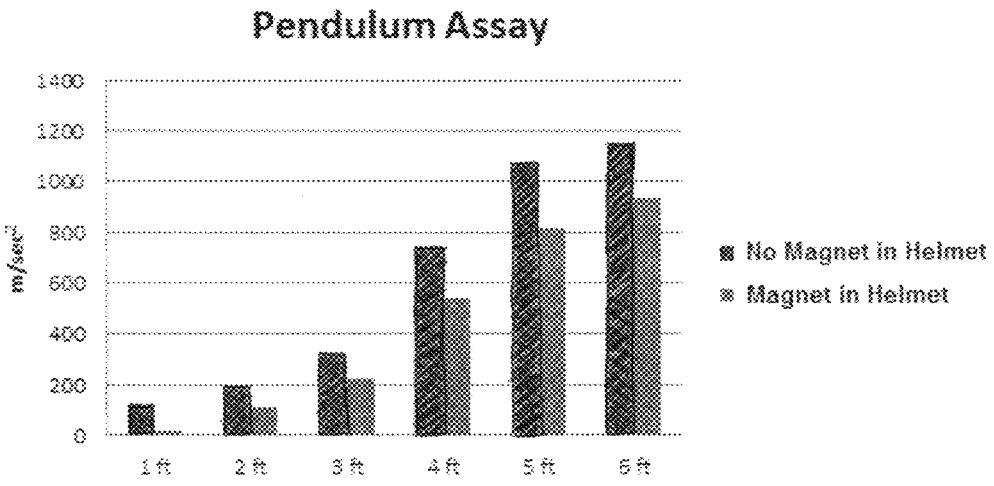
FIG. 12 is a graph showing the results of a pendulum acceleration assay.

Results of the experiment are provided in FIG. 12. Helmets were dropped in height increments of 1 foot up to 6 feet, and peak acceleration was measured with an accelerometer. When magnets were added to the helmets, peak acceleration was substantially less for all heights tested. Note that the helmets repel one another; they do not touch, even when one is dropped from up to 6 feet.

These studies demonstrated the significant repulsive force of neodymium magnets and how this force can be used to reduce impact forces generated at helmet-to-helmet collision.

An unexpected result observed during the handling of the prototype magnetic helmets described above gave rise to a further improvement of the invention design. Specifically, when the helmets are brought into proximity to one another in a non-linear impact wherein side to side motion is also possible, one of two outcomes can occur depending on the angle of impact and force of impact: 1) the helmets "whip" past one another as linear force is converted to laminar motion, or 2) the helmets can stick together. The first instance has already been discussed earlier in this specification, but the second instance was not obvious.

Figure 6A:
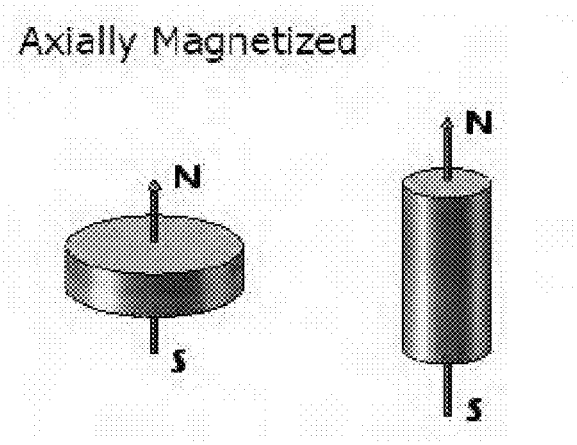
FIG. 6A is a schematic illustration of axial magnetization.
Figure 6B:
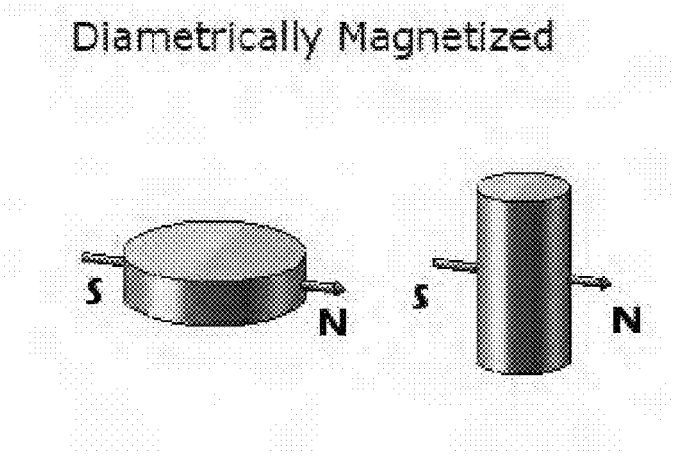
FIG. 6B is a schematic illustration of diametrical magnetization.
Figure 7D:
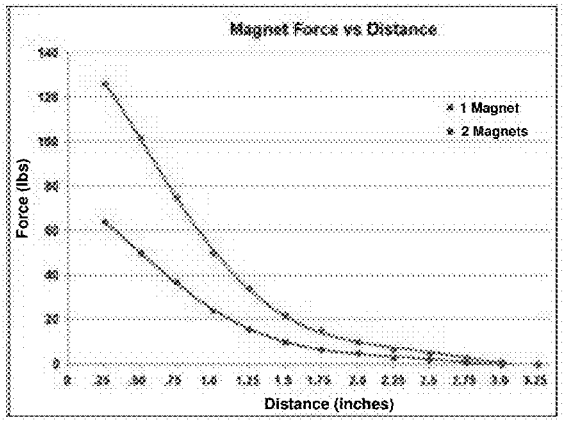
FIG. 7D is a graphical representation depicting the repulsive force generated by the magnet systems illustrated in FIGS. 7B and 7C.

Axially magnetized disc magnets such as those shown in FIGS. 6A-6B produce magnetic fields not just in the north/south directions (see FIG. 6A), but to the sides as well (see FIG. 6B). The magnetic fields emanating from the sides of strong magnets such as neodymium magnets can and does cause the magnets to attract one another and stick together with great force, even when both north poles are facing up. Therefore, in some instances of impact the magnets inside the prototype helmets caused the helmets to stick together. This unexpected effect in the prototype helmet system illustrated that players wearing these helmets could be at best inconvenienced and at worst injured on the playing field. Further modifications to the magnetic helmet system, were made to improve helmet performance.

Example 5: Spatially Modulated Magnetic Field Modifications

Elimination of the helmets sticking together was achieved by spatially modulating the magnetic fields around the helmet. FIG. 13 is a general illustration of how magnetic shielding with steel redirects the magnetic field so that it changes shape when a disc magnet is placed on a steel plate. Specifically, FIG. 13 illustrates shaping of the magnetic field and the axis of magnetization (22) of an axially magnetized disc magnet (20) placed on a ferromagnetic shield material (21) such as a steel plate.

Shaping of the magnetic field was accomplished by cupping the magnets in steel cups of $3/16^{th}$ inch thickness. FIG. 14 illustrates placement of a disc-shaped magnet (in this instance a hollow disc or ring) (25), into a steel cup (23) with an impact-absorbing spacer (24) between the brittle magnet and the cup. Note that the edges of the cup (33) may be smooth as depicted or threaded like a screw in order to screw into sockets incorporated within the polycarbonate shell or sockets attached to the polycarbonate shell by fastener or adhesive.

FIGS. 15 and 16 illustrate how the steel cups direct the magnetic field upwards (arrows) thus mitigating the ability of the neodymium magnets to attract one another from the sides, and increasing the strength of the magnetic field on the exposed magnet surface.

In particular, FIG. 15 illustrates the SMMF of two opposing cupped magnets, with directionality of shaped magnetic field shown with arrows (26). As with FIG. 14, a disc-shaped magnet (in this instance a hollow disc or ring) (25), was placed into a steel cup (23) with an impact-absorbing spacer (24) between the brittle magnet and the cup.

FIG. 16 illustrates two opposing arrays of cupped magnets arranged at an offset in an "egg-crate" pattern in two opposing helmets. Black lines (28) represent polycarbonate shells, arcs/arches (27) represent SMMFs of component magnets of the array. Space between the exterior of the helmets due to the magnetic repulsion (30) varies with the strength of the summed SMMF of the array. The steel cups (23) may be completely encased in a polycarbonate shell in some embodiments. In other embodiments the bottom of the steel cups (29) and/or sides (33) may be visible on the helmet interior, and the steel cup may be affixed by any adhesive or fastener or combination thereof known to those in the art (examples of fasteners are provided above). The inner lining of the helmet(s) is located below the bottom of the cup (29) and is not illustrated in the drawing.

Since placing a ferromagnetic material like steel or mu-metal on one side or around a magnet may double the strength of the field on the unexposed side, it is believed to be possible with this design to use smaller, lighter, or thinner magnets in order to achieve the same force of repulsion between helmets; and, it would make it possible to use arrays of smaller magnets such as in FIG. 16 in place of single large magnets or large composite magnets. Incorporating smaller magnets with SMMF shaped by magnetic shielding would also decrease the weight of the helmet, but retain the same performance characteristics. It will also make it possible to use multiple sizes, strengths and shapes of magnets in helmets designed for different levels of play. (See Table 2). Such data can be important in particular applications, since the size and speed of players (and thus impact forces) increase as players go from peewee leagues to high-school to college.

TABLE 2

Repulsive Forces Based on Magnet Dimensions

| Magnet | Size | Weight (oz) | Repulsive Force (lbs) |
|---|---|---|---|
| DX08B-N52 | 1" dia × ½" thick | 1.7 | 17 |
| DX88-N52 | 1.5" dia × ½" thick | 3.4 | 34 |
| DY08-N52 | 2" dia × ½" thick | 6.8 | 68 |
| DZ08-N52 | 3" dia × ½" thick | 15 | 90 |

The optimal SMMF shaping could also be accomplished by use of materials such as mu metals (described above) or by use of a Halbach array of magnets that directionalizes the magnetic field. FIGS. 17 A-B are illustrative.

Figure 17A:
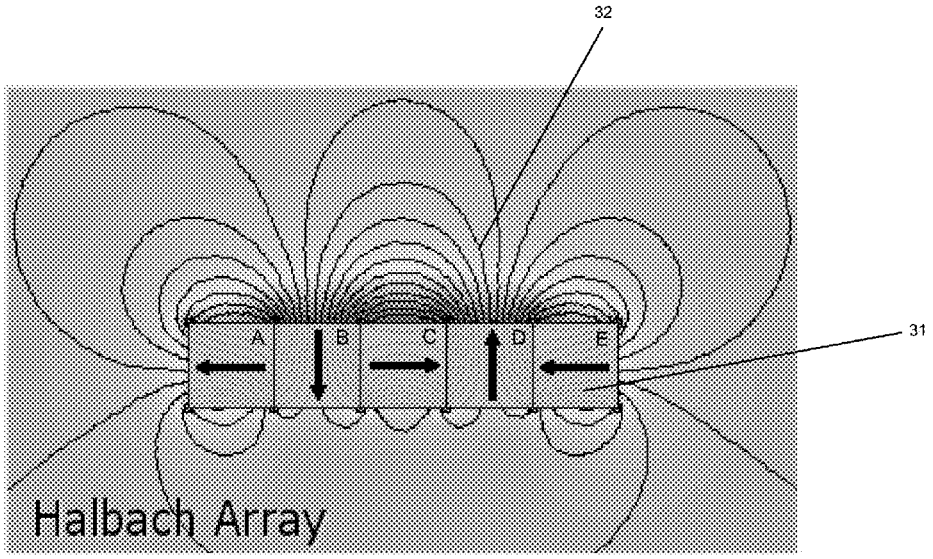
FIGS. 17A and 17B are schematic illustrations showing the SMMF of multiple magnets placed in a Halbach array.
Figure 17B:
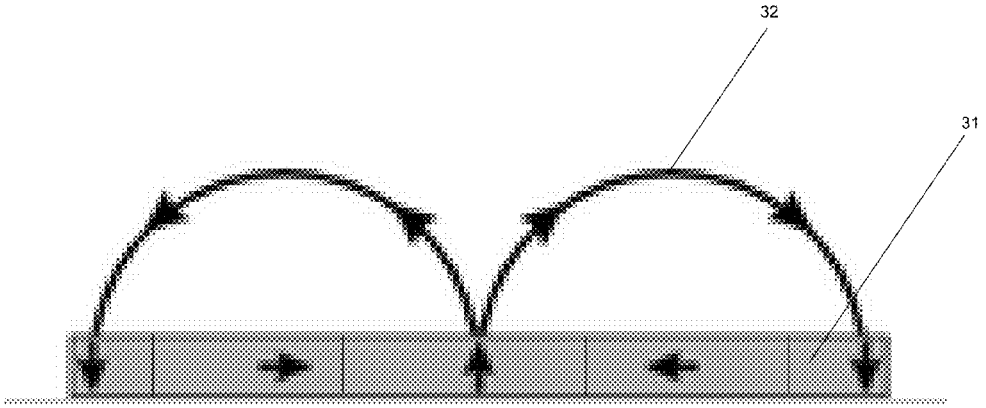

FIG. 17A illustrates SMMF in a Halbach array composed of 5 magnets labeled A though E in which the north pole of the magnet is indicated by the directionality of the black arrow. Individual magnets (31) are affixed to one another by means known to those familiar with the art in a configuration that directs the magnetic field (32) to one side of the array. Strength of the magnetic field is strongest next to the array surface and decreases with distance from the array. No ferromagnetic backing material is needed to direct the magnetic field in a Halbach array. FIG. 17B is another general illustration of a Halbach array composed of individual magnets (31) and generating a SMMF (32).

Importantly, the helmets were still able to decelerate collisions and reduce impact forces, and thus can be incorporated into a system of helmets to reduce concussion injuries and neck injuries on the playing field.

As can been seen from the experimental results, unlike traditional approaches that aim to reduce concussions by decreasing impact forces after the collision has occurred, our novel approach does something completely different, that is, to put a brake on the impact before it even occurs. These results suggest that the addition of magnets to the standard football helmet design would slow the velocity of a helmet immediately before the collision and dissipate energy immediately after impact. Such a magnet system could be used as the sole means to dissipate energy or could be combined with traditional cushions. The consequence of this novel helmet modification is a reduction in the number of concussions on the playing field. The detailed description and drawings or figures are supportive and descriptive of the embodiments described herein, and while some of the preferred embodiments have been described in detail, various alternative designs and embodiments exist for practicing the helmet disclosed herein. It is expressly noted that the present invention is not limited to the embodiments described in detail herein; rather, modifications and additions to what has been expressly described herein are also included within the scope of the invention. Moreover, it will be understood that the features of the various embodiments described herein are not generally mutually exclusive and can exist in various combinations and permutations without departing from the spirit and the scope of the invention.

The invention claimed is:

1. A helmet comprising:

a protective outer shell with an interior contoured surface having a defined curvature;

an inner lining; and at least three magnets curved to match the curvature of the interior contoured surface of the outer shell and disposed between the outer shell and the inner lining in a manner to together provide a near-uniform repulsive force.

2. The helmet of claim 1, wherein a first magnet is disposed in the front of the helmet, a second magnet is disposed on one side of the helmet, and a third magnet is disposed on the side of the helmet opposite the second magnet.

3. The helmet of claim 1, wherein the near-uniform repulsive force is generated by a Halbach array.

4. The helmet of claim 1, wherein the near-uniform repulsive force is generated by a composite magnet.

5. The helmet of claim 1, wherein the at least one magnet is a permanent magnet.

6. The helmet of claim 5, wherein the permanent magnet comprises at least one rare earth metal selected from the group consisting of gadolinium, terbium, erbium, dysprosium, scandium, yttrium, lanthanum, praseodymium, samarium, europium, holmium, thulium, ytterbium, lutetium, neodymium, alloys thereof, and combinations thereof.

7. The helmet of claim 1, wherein at least one of the magnets comprises neodymium.

8. The helmet of claim 1, wherein at least one of the magnets comprises at least one ferromagnetic material.

9. The helmet of claim 8, wherein the ferromagnetic material is selected from the group consisting of iron, cobalt, nickel, gadolinium, dysprosium, alloys thereof, europium oxide, ferric oxide, and combinations thereof.

10. The helmet of claim 8, wherein the ferromagnetic material is iron.

11. The helmet of claim 8, wherein the magnet is a neodymium-iron-boride (NdFeB) magnet.

12. The helmet of claim 1, wherein at least one of the magnets is shielded by a magnetic shielding material.

13. The helmet of claim 12, wherein the magnetic shielding material is a mu-metal.

14. The helmet of claim 13, wherein the mu-metal is a NiFe alloy.

15. The helmet of claim 12, wherein the magnet is shielded by steel.

16. A helmet system comprising:

a first helmet comprising at least one magnetic element configured to provide for a first spatially modulated magnetic field; and a second helmet comprising at least one magnetic element configured to provide for a second spatially modulated magnetic field, wherein the first spatially modulated magnetic field and the second spatially modulated magnetic field are configured to allow repulsive force between the first helmet and the second helmet;

wherein the first spatially modulated magnetic field and the second spatially modulated magnetic field are configured to fit together to prevent laminar motion between the first helmet and the second helmet; and wherein the first spatially modulated magnetic field and the second spatially modulated magnetic field are configured such that when the magnetic elements in the first and second helmets approach one another, the helmets do not stick together.

17. The helmet system of claim 16, wherein the first spatially modulated magnetic field is generated by a Halbach array.

18. The helmet system of claim 16, wherein the second spatially modulated magnetic field is generated by a Halbach array.

19. The helmet system of claim 16, wherein the magnetic elements of the first and second helmets contain neodymium-iron-boride (NdFeB) magnets.

20. The helmet of claim 1, wherein at least one of the magnets has a weight of ¼ pound and is backed by ferromagnetic shielding material and is capable of producing a repulsive force of at least 100 pounds.

21. The helmet of claim 1, wherein at least one of the magnets is a disc-shaped magnet in combination with a steel cup, wherein the steel cup comprises exterior threading for screwing the cup into a socket of the protective shell.

22. The helmet of claim 21, wherein the socket of the protective shell comprises cooperative threading on an interior of the socket for cooperation with the exterior threading of the steel cup.

* * * * *